US009631806B2

(12) United States Patent
Mabry et al.

(10) Patent No.: US 9,631,806 B2
(45) Date of Patent: Apr. 25, 2017

(54) DEVICE FOR HOUSING ELECTRONICS AND OPTICS AT THE LEADING EDGE OF A FIRE SUPPRESSION OPERATION

(71) Applicant: All Clear Fire Systems, LLC, Phoenix, AZ (US)

(72) Inventors: James Mabry, Anthem, AZ (US); Danny Kleitsch, Scottsdale, AZ (US)

(73) Assignee: All Clear Fire Systems, LLC, Phoenix, AZ (US)

( * ) Notice: Subject to any disclaimer, the term of this patent is extended or adjusted under 35 U.S.C. 154(b) by 0 days.

(21) Appl. No.: 14/584,346

(22) Filed: Dec. 29, 2014

(65) Prior Publication Data

US 2016/0169502 A1 Jun. 16, 2016

Related U.S. Application Data

(63) Continuation-in-part of application No. 13/665,618, filed on Oct. 31, 2012, now Pat. No. 8,919,979.

(51) Int. Cl.

| | |
|---|---|
| ***F21V 33/00*** | (2006.01) |
| ***A62C 33/00*** | (2006.01) |
| *A62C 31/28* | (2006.01) |

(52) U.S. Cl.

CPC ..... *F21V 33/0064* (2013.01); *A62C 33/00* (2013.01); *A62C 31/28* (2013.01); *Y10S 239/00* (2013.01)

(58) Field of Classification Search

CPC ..... F21V 33/0064; A62C 31/02

See application file for complete search history.

(56) References Cited

U.S. PATENT DOCUMENTS

| | | | | |
|---|---|---|---|---|
| 3,706,882 | A | 12/1972 | Eby | |
| 3,805,516 | A | 4/1974 | Eastham et al. | |
| 3,943,312 | A | 3/1976 | Bernstein et al. | |
| 4,031,775 | A | 6/1977 | Petty | |
| 4,548,092 | A | 10/1985 | Strong, Jr. | |
| 4,729,070 | A * | 3/1988 | Chiu | F21V 17/02 362/227 |
| 5,092,504 | A | 3/1992 | Hannes et al. | |
| 5,485,811 | A | 1/1996 | Jacobsen et al. | |
| 5,795,053 | A | 8/1998 | Pierce | |

(Continued)

OTHER PUBLICATIONS

All Clear Fire Lights—Archived Website Publication—Captured Jan. 29, 2011—http://web.archive.org/web/20110129143936/http://www.allclearfirelights.com/.

(Continued)

*Primary Examiner* — Andrew Coughlin
*Assistant Examiner* — Alexander Garlen
(74) *Attorney, Agent, or Firm* — Venjuris, P.C.

(57) ABSTRACT

A device for housing electronics and optics at the leading edge of a fire suppression operation. The device can be attached to a fire hose, water discharge outlet on a fire engine/ladder truck. The device can enhance fire ground visibility by means of a lighting source, enhance fire ground communication by means of a video monitoring source, enhance operation using infrared thermal imaging and enhance fire fighter safety by means of an atmospheric/biological metering/monitoring/warning source. All of these enhancements are preferably contained in one, unit with the ability to be deployed anywhere on the fire scene.

16 Claims, 29 Drawing Sheets

(56) References Cited

U.S. PATENT DOCUMENTS

| | | | | |
|---|---|---|---|---|
| 5,873,647 | A | 2/1999 | Kurtz | |
| 6,036,069 | A | 3/2000 | Sayegh | |
| 6,116,520 | A | 9/2000 | Lee | |
| 7,739,921 | B1 | 6/2010 | Babcock | |
| 7,823,801 | B2 | 11/2010 | McGarry et al. | |
| 7,942,544 | B2 | 5/2011 | Smathers | |
| 7,969,414 | B2 | 6/2011 | Wang et al. | |
| 7,992,648 | B2 | 8/2011 | Groonwald | |
| 8,109,645 | B2 | 2/2012 | Liao | |
| 2004/0069826 | A1 | 4/2004 | Neil | |
| 2004/0134953 | A1 | 7/2004 | Perez | |
| 2004/0159690 | A1 | 8/2004 | Hansen | |
| 2006/0131038 | A1 | 6/2006 | Lichtig | |
| 2006/0180321 | A1 | 8/2006 | Yoshida | |
| 2009/0050835 | A1 | 2/2009 | Boise | |
| 2011/0187524 | A1 | 8/2011 | Cochran, III | |
| 2012/0061108 | A1 | 3/2012 | Cerrano | |
| 2012/0120630 | A1 * | 5/2012 | Liao | F21V 33/0064 362/96 |

OTHER PUBLICATIONS http://www.jamesdysonaward.org/projects/projext.aspx?ID=1262
Minoraur Fire Nozzle System Date Accessed: Jul. 17, 2012.

* cited by examiner

SECTION B-B

Fig. 21
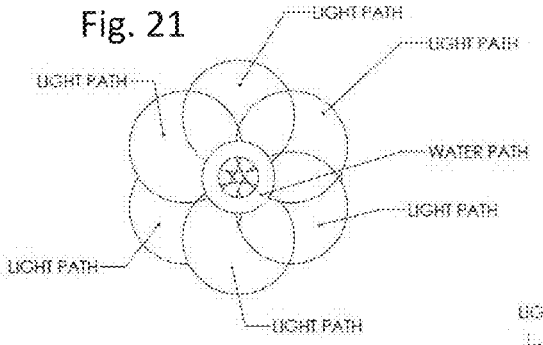
Fig. 23
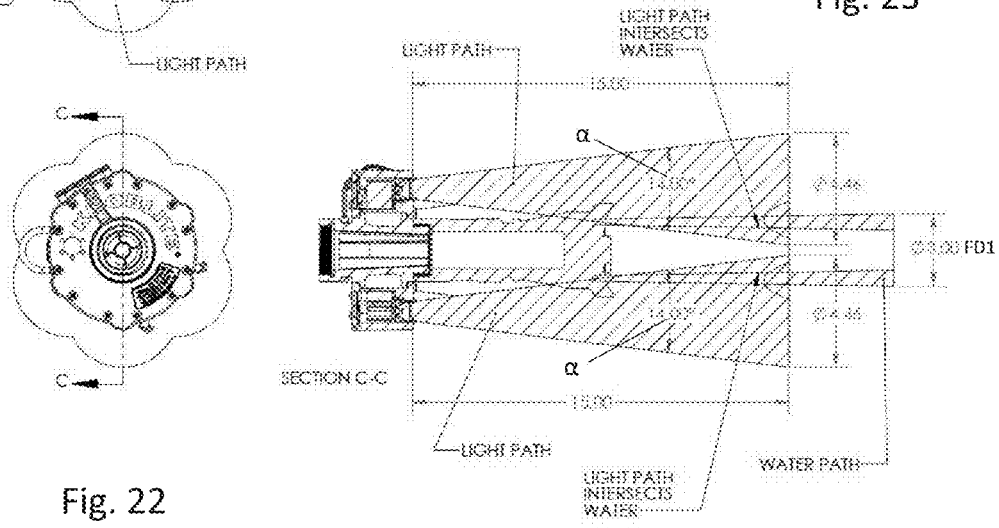
Fig. 22

DEVICE FOR HOUSING ELECTRONICS AND OPTICS AT THE LEADING EDGE OF A FIRE SUPPRESSION OPERATION

CROSS-REFERENCE TO RELATED APPLICATIONS

The present application claims priority to co-pending United States non-provisional patent application entitled "Electronic Apparatus For Hose Attachment To Enhance Visibility, Communication, Atmospheric Monitoring, Early Detection and Warning for Fire Fighter Scene Safety and Method Therefor" having Ser. No. 13/665,618, filed on Oct. 31, 2012, which is entirely incorporated herein by reference.

FIELD OF INVENTION

This invention generally relates to firefighting equipment and more particularly pertains to a device for housing optics and battery-powered electronics at the leading edge of a fire suppression operation.

BACKGROUND

Today's fire fighters are asked to fill many roles and operate on diverse emergency scenes. These scenes include structural firefighting, wild land firefighting, vehicular accidents, technical rescues, hazardous material exposures, and emergency medical incidents. All of these incident scenes present unique and different challenges. One of the commonalities is the utilization by fire fighters of hand lines with various extinguishing agents on almost every scene. Fire fighters use these hand lines not only to extinguish fire, but to protect themselves and the citizens they are called to serve, at any scene day or night.

Temperatures at the nozzle end of a hand line (i.e., the "tip of the spear") can exceed 1,000° F. Such extreme temperatures make operating battery powered electronic devices such as high intensity lighting, infrared cameras, video cameras challenging because the battery power needed is prone to failure and even explosion at such extreme temperatures. Having a device that can protect electronics, particularly batteries, at the leading edge of a fire suppression operation would allow firefighters access to critical electronic components where it is needed most. Likewise, monitoring current conditions and providing warning systems to alert fire fighters of hazardous conditions can be critical to avoiding injury and locating lost or incapacitated fire fighters.

In addition to the extreme heat, communication from the "tip of the spear" is a critical component of effective and safe operations on the fire ground, emergency medical scene, hazardous material situations, technical rescues, natural disasters, and homeland security. On today's emergency scene task level workers are forced to communicate with on-scene incident commanders almost exclusively by means of radio transmissions. Those personnel doing the work are expected to relay their environmental conditions, actions, and needs to supervisors and alarm room staff distant from their location. Incident commanders and alarm room staff are required to visualize what is actually happening on the scene relative to their personal experience and understanding of these radio transmissions.

While there have been attempts to equip fire fighters, paramedics, emergency medical technicians, and other first responders with helmet-mounted or body mounted video cameras. These cameras cannot presently be used at the leading edge of a fire suppression operation because of the extreme heat. In addition, these cameras are basically useless in low light/no light environments. They record what they see and in limited visibility situations they are unable to see much, if anything. The dynamic nature of these scenes would benefit from increased visibility and live video streaming to enhance communication and protect the privacy of all people on and in the vicinity of the emergency scene.

Finally, fire fighters are required to carry an inordinate number of hand tools to include personal flashlights, scene lighting, extrication tools, firefighting tools, medical equipment, and radios. The complexity of the work environment and minimum staffing on most emergency scenes makes it virtually impossible for crews to be adequately prepared and carry all the tools they need for any one situation. The necessity to return to on scene fire vehicles to retrieve additional equipment is time consuming and dangerous. Fire fighters need a new option to lessen their work loads, enhance visibility, improve communication, identify unseen hazards, provide early warning, and make the operating environment a more efficient and safer place to work.

Therefore, it would be desirable to provide a device and method that overcomes the above problems. The device and method would provide a hands-free tool to assist fire crews involved in search, rescue, and fire suppression efforts. The device and method would provide enhanced lighting, video monitoring, and other sensory informational capability to be used in firefighting operations inside or outside a structure.

In part, the device and method would provide for atmospheric monitoring to detect hazardous materials in the work environment. The device and method would provide for personal health monitoring of individual fire fighters to promote early treatment for sickness or injury. The device and method would act as an early warning device for structure collapse, self-contained breathing apparatus air management, or lost/incapacitated fire fighter. The device and method would preferably provide these benefits and enhanced communication through a hands-free/voice-free lighting system easily visible to the fire fighters on the face of the device with an integrated video monitoring and other sensory capability able to provide real time video presentation to incident commanders at locations distant from the engaged fire fighters. With this capability, command units on the perimeter of the emergency scene would be constantly apprised of firefighting operating conditions and could communicate instantly the necessity to change strategy, withdraw crews from dangerous situations, or effect a rescue.

SUMMARY

The present invention is incorporated in a device 10 for housing electronics and optics at the leading edge (the "tip of the spear") of a fire suppression operation. The device 10 can be attached to a fire hose or water discharge outlet on a fire engine/ladder truck. The device 10 enhances fire ground visibility by means of a lighting source, enhances fire ground communication by means of a video monitoring source, and enhances fire fighter safety by means of an atmospheric/biological metering/monitoring/warning source. All of these enhancements are preferably contained in one unit with the ability to be deployed anywhere on the fire scene.

The preferred device 10 comprises a housing that can allow a substance from a hose to flow through the housing. A variety of electronic circuitry 70 can be protected in an interior of the housing to withstand the extreme conditions encountered at the leading edge of a fire suppression operation. The device 10 preferably has its own internal power source, external power source, and charging system capable of extending operational readiness in remote locations. The preferred device 10 can attach to a hose or be carried by a person.

In operation, the device 10 enhances situational awareness on emergency scenes with integrated high-power LED lighting. Through properly focused reflectors and quartz lenses, fluid flowing from a mobile hand line, fixed ground monitor position, fire engine nozzle, fire ladder nozzle, or mobile apparatus can be illuminated for the distance of its travel. This illuminated fluid can facilitate easier application of water/foam in limited visibility environments on the emergency scene. The UV nature of the emitted light from the device 10 affixed to a hand line on the interior of a structure has been found to illuminate water vapor resulting in increased visibility.

The device 10 can be equipped with numerous metering/monitoring devices that extract atmospheric samples from the ambient environment, provide real time evaluation of those samples, and provide an alarm to warn emergency responders of possible hazardous conditions. An example would be an integrated component to the device 10 that warns the emergency responders of excessive x-ray or gamma radiation levels in the operational area. The scope and function of the metering/monitoring explanation should in no way be limited by the example.

The device 10 can be equipped with numerous personal metering/monitoring devices that evaluate biological functions of the on scene emergency responders (i.e. heart rate, skin temp, etc.) and alert scene commanders of the need to provide medical care or replacement work crews. The device 10 could contain a GPS chip to allow incident commanders to track the location of fire fighters and other emergency responders in the "hot zone."

The current device 10 can contain several safety features that provide warnings to firefighters and assist them should they become lost or incapacitated in the course of their work. An integrated timer can provide a prompt, in conjunction with standard elapsed time protocol, to remind fire fighters to continually be vigilant regarding the condition of the burning structure, personal air management, and condition/location of other fire fighters.

The device 10 provides safeguards should a firefighter become separated from the hand line, disoriented, or lost due to decreased visibility. The device 10 has a hook 33 attached to the rear plate of the housing cover. Should a fire fighter be involved in a structural collapse or other life threatening situation in the hot zone, the fire fighter can secure the water flow in a hand line, disconnect the device 10 from the fire nozzle/hose, and attach the hook 33 to the fire fighter's turnout coat to provide hands-free use during egress.

The device 10 can be equipped with communication upgrades that enhance the quality and effectiveness of communication on the emergency scene. The device 10 can be fitted with components that boost radio/wireless signals on the interior of a structure or in wild land firefighting situations that overcome the obstacles of construction "dead zones" and topography.

During time of natural disaster or homeland security threats the device 10 can be affixed to fire engines, ladder trucks, and emergency vehicles acting as mobile cell phone repeaters. When existing cell phone towers are down or dysfunctional, mobile emergency vehicles can patrol disaster areas and answer the emergency needs of citizens previously unable to communicate with civil authorities.

It is an object of this invention to support the transmittal of real-time video streaming from the "tip of the spear."

It is another object of this invention to support thermal imaging cameras connected to the device: short wave infrared, ultraviolet, and all cameras across the visible/non-visible light spectrum.

It is an another object of this invention to house electronics for supporting a video camera capable of capturing video images and transmitting those images via wireless technology to a mobile device or monitor at a remote location.

It is another object of this invention to provide incident commanders and alarm room staff with live, streaming video from the scene that enables them to make more timely and prudent decisions to assist on scene personnel.

It is another object of this invention to enable firefighters and emergency medical personnel to send live, streaming video to hospital emergency rooms to allow doctors, nurses, and staff to make better triage decisions and promote better patient outcomes. In essence, all those involved in emergency scene management will be able to visually monitor and evaluate scene operations while respecting the privacy and dignity of those involved in those operations.

The features, functions, and advantages may be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein:

FIG. 21 is a front view of the device 10 of FIG. 17 with the lights on and fluid flowing though the hose;

FIG. 22 is a back view of device 10 of FIG. 17 with the lights on;

FIG. 23 is a sectional view of FIG. 22 taken along cut line C-C;

DETAILED DESCRIPTION

Figure 1:
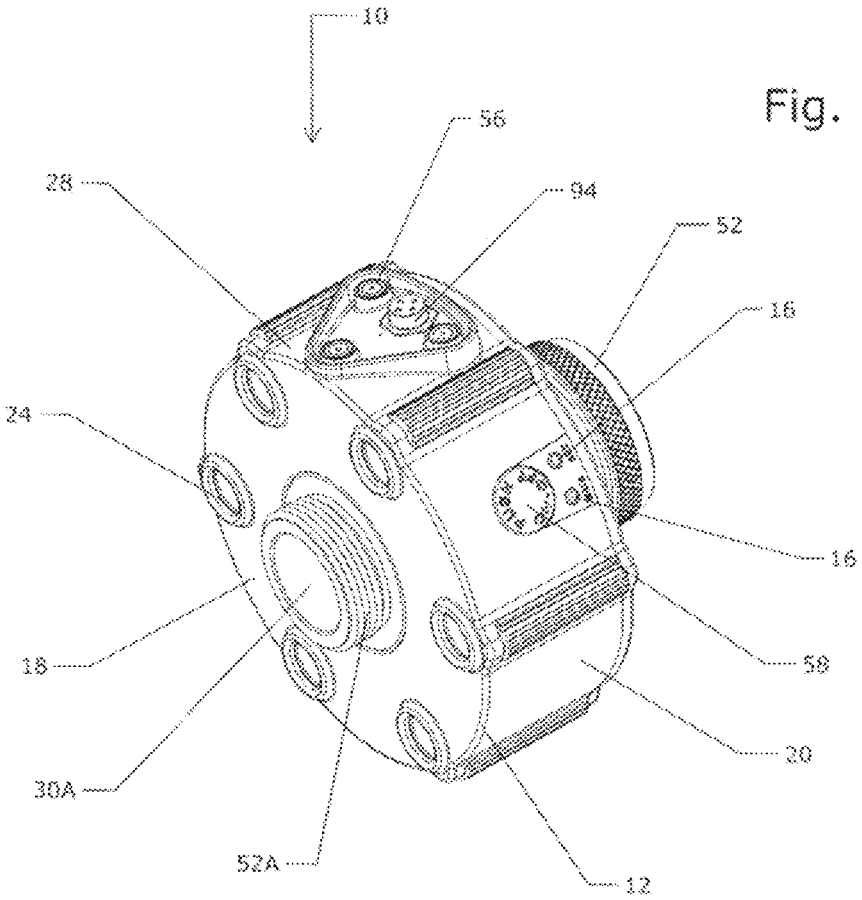
FIG. 1 is a first elevated perspective view of an embodiment of the device of the present invention.
Figure 2:
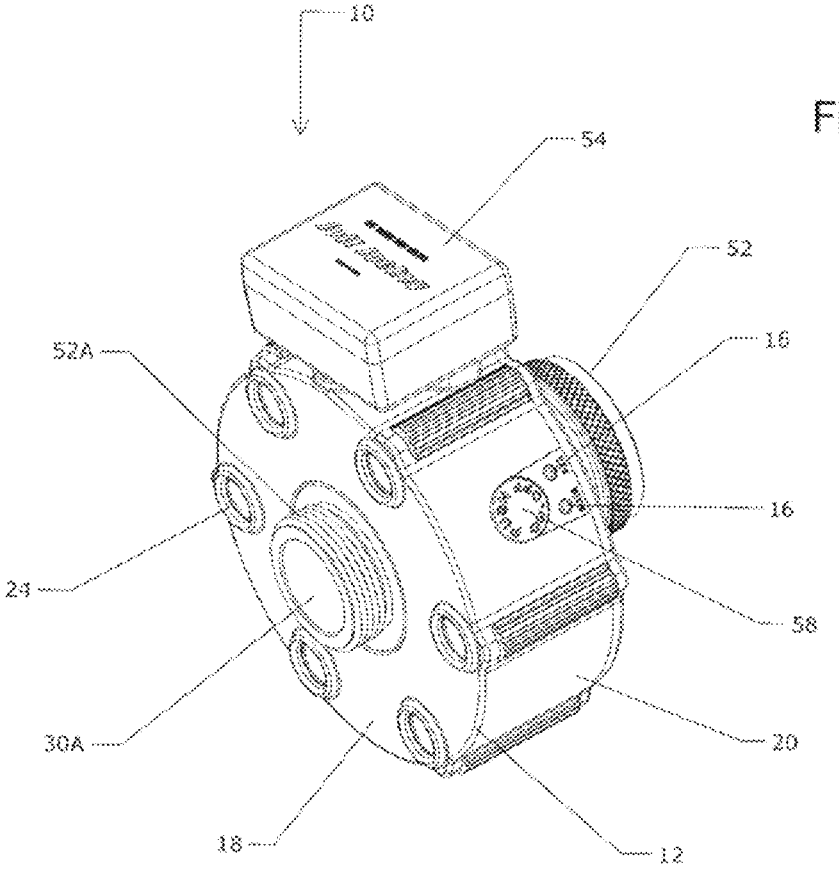
FIG. 2 is the first elevated perspective view of the device in accordance with FIG. 1 with a removable battery pack attached thereto.
Figure 3:
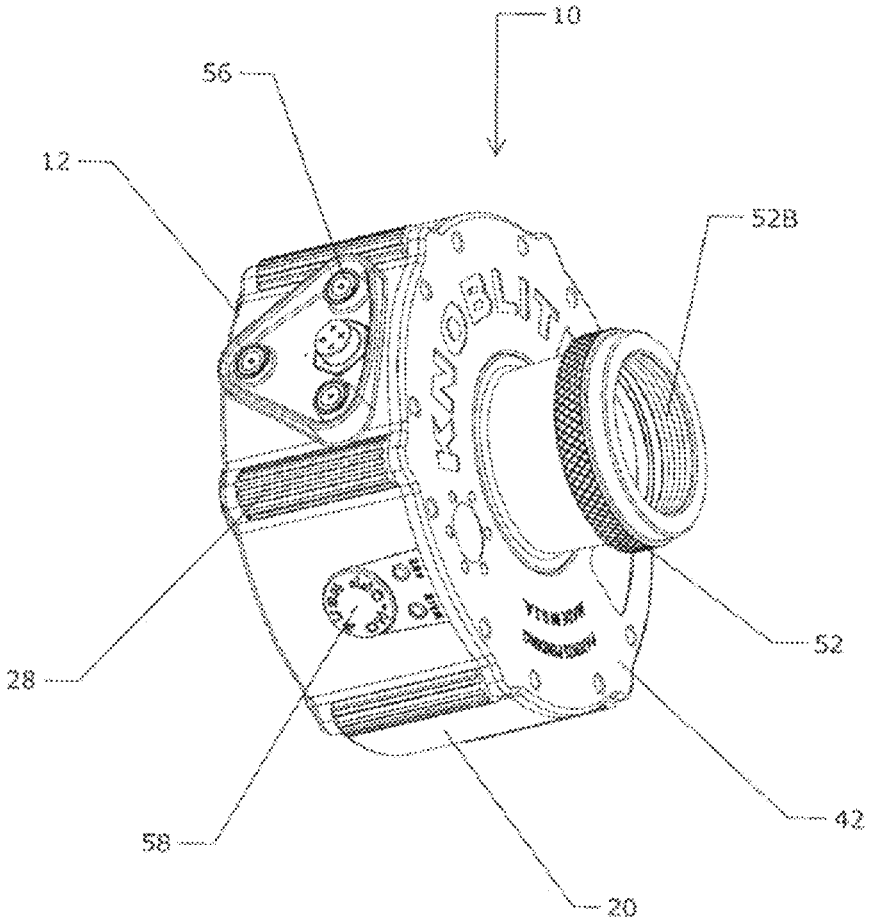
FIG. 3 is a second elevated perspective view of an embodiment of the device of the present invention.
Figure 4:
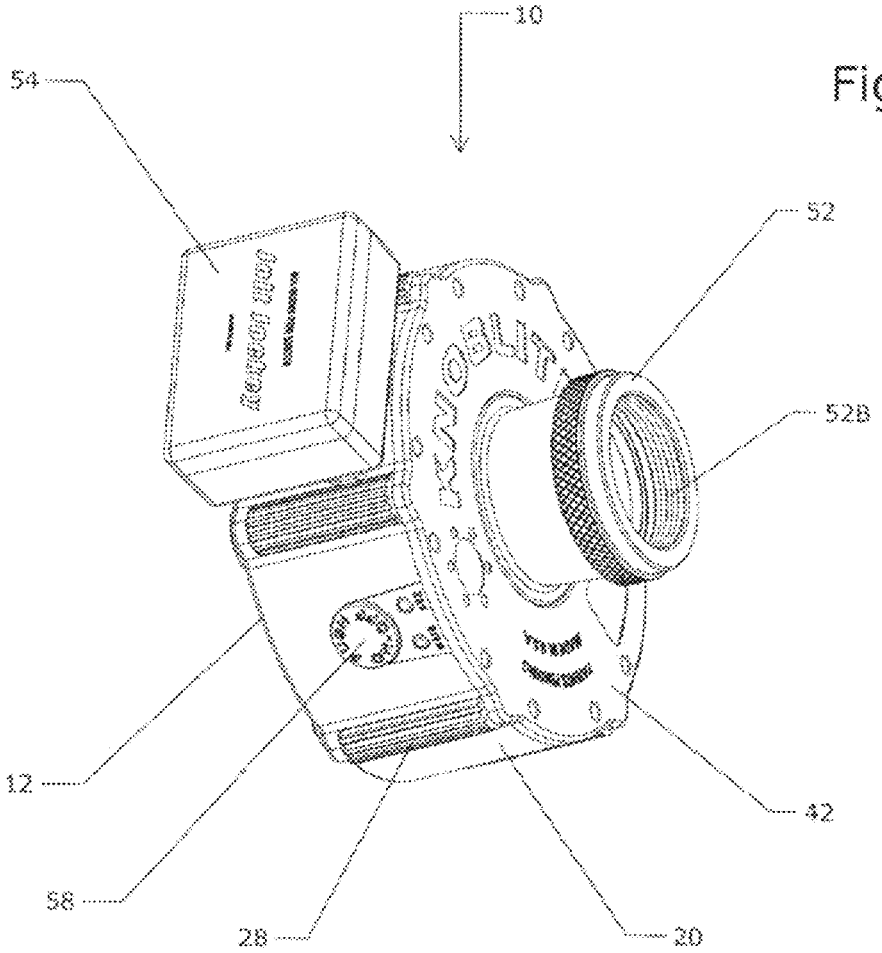
FIG. 4 is the second elevated perspective view of the device in accordance with FIG. 2 with the removable battery pack attached thereto.
Figure 5A:
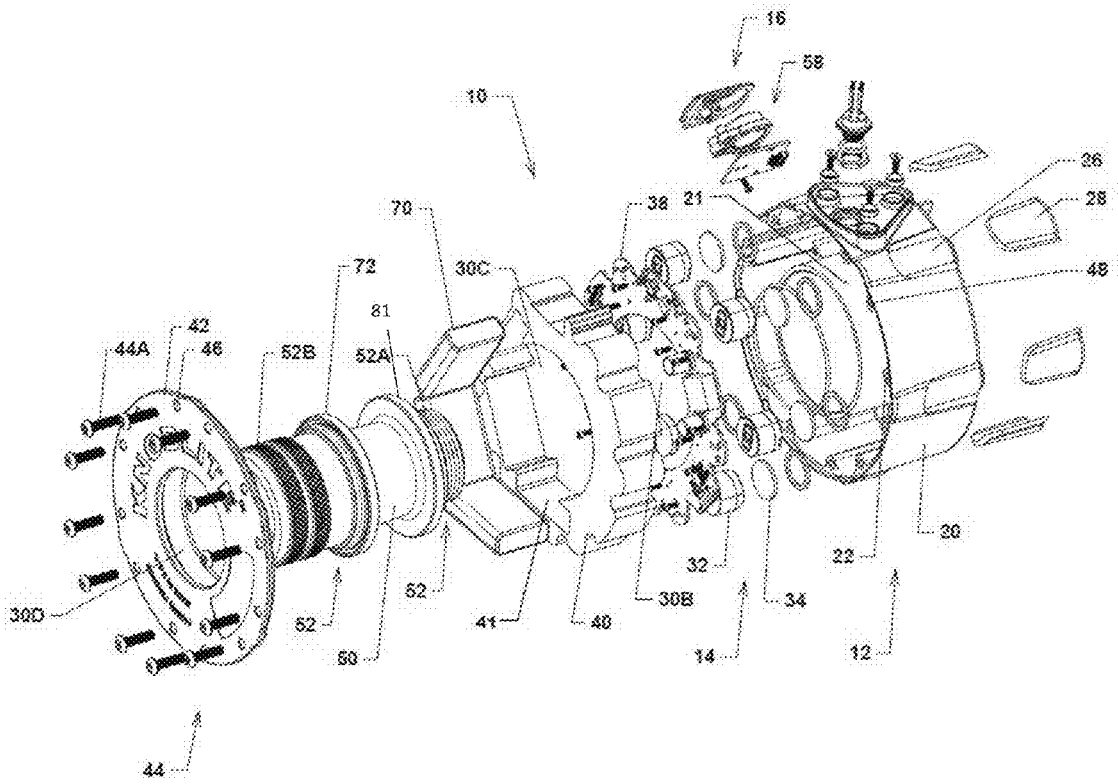
FIG. 5A is an exploded side view of one embodiment of the device of the present invention.
Figure 5B:
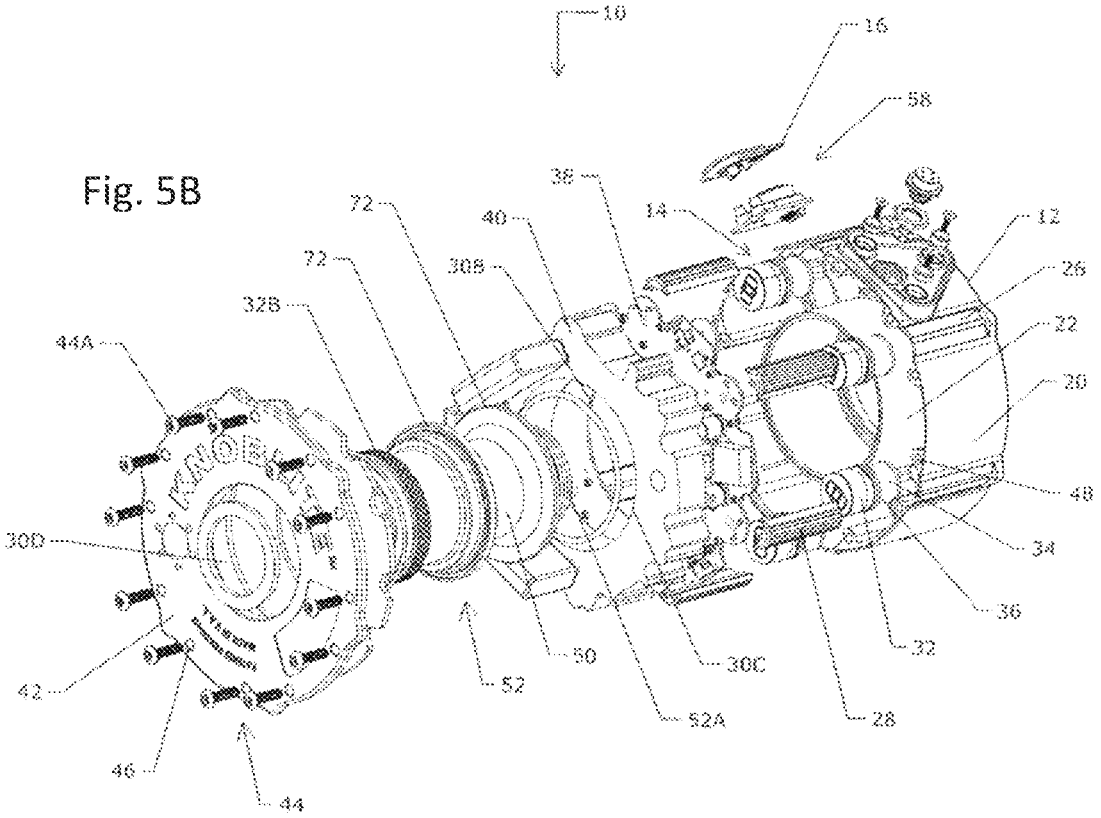
FIG. 5B is an exploded side view of a second embodiment of the device of the present invention.
Figure 5C:
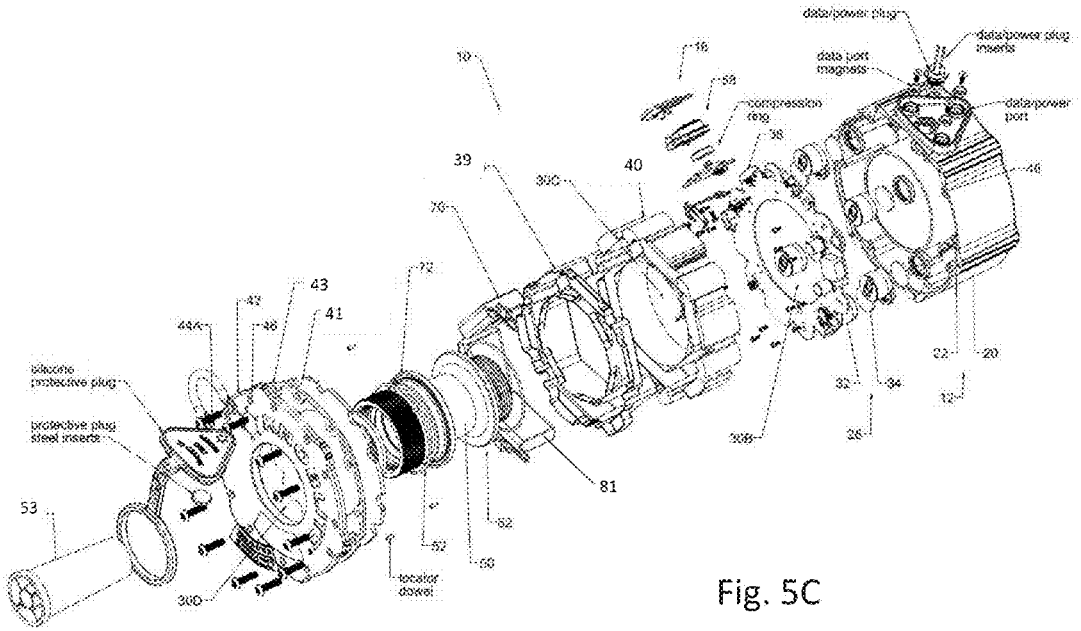
FIG. 5C is an exploded side view of the presently preferred embodiment of the device of the present invention.
Figure 6:
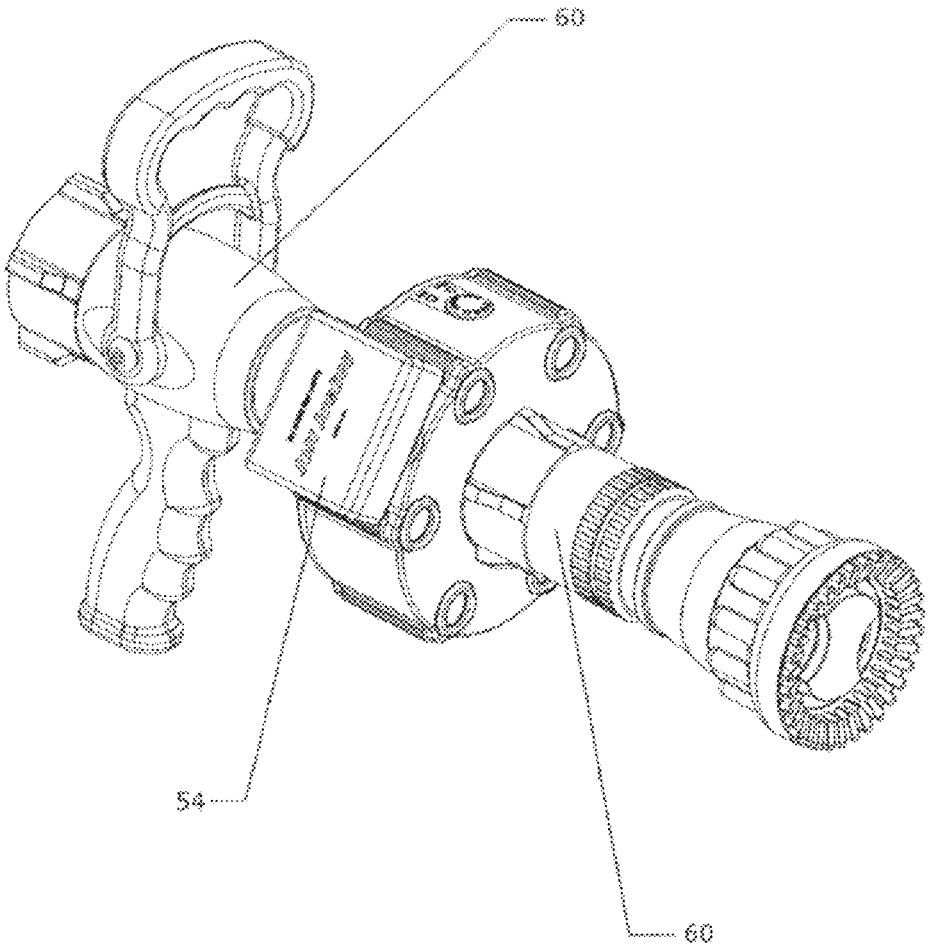
FIG. 6 is a first elevated perspective view of an embodiment of the device with a removable battery pack attached to a fire hose.
Figure 7:
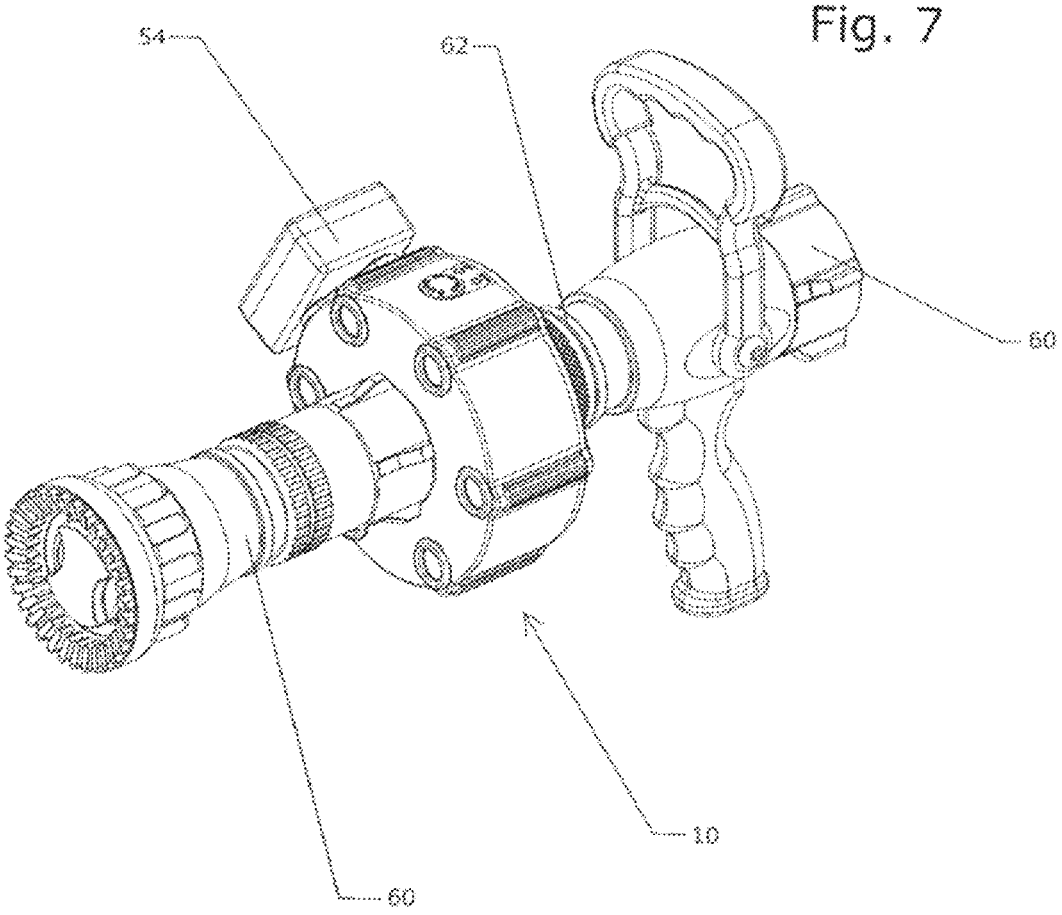
FIG. 7 is a second elevated perspective view of an embodiment of the device with a removable battery pack attached to a fire hose.
Figure 8:
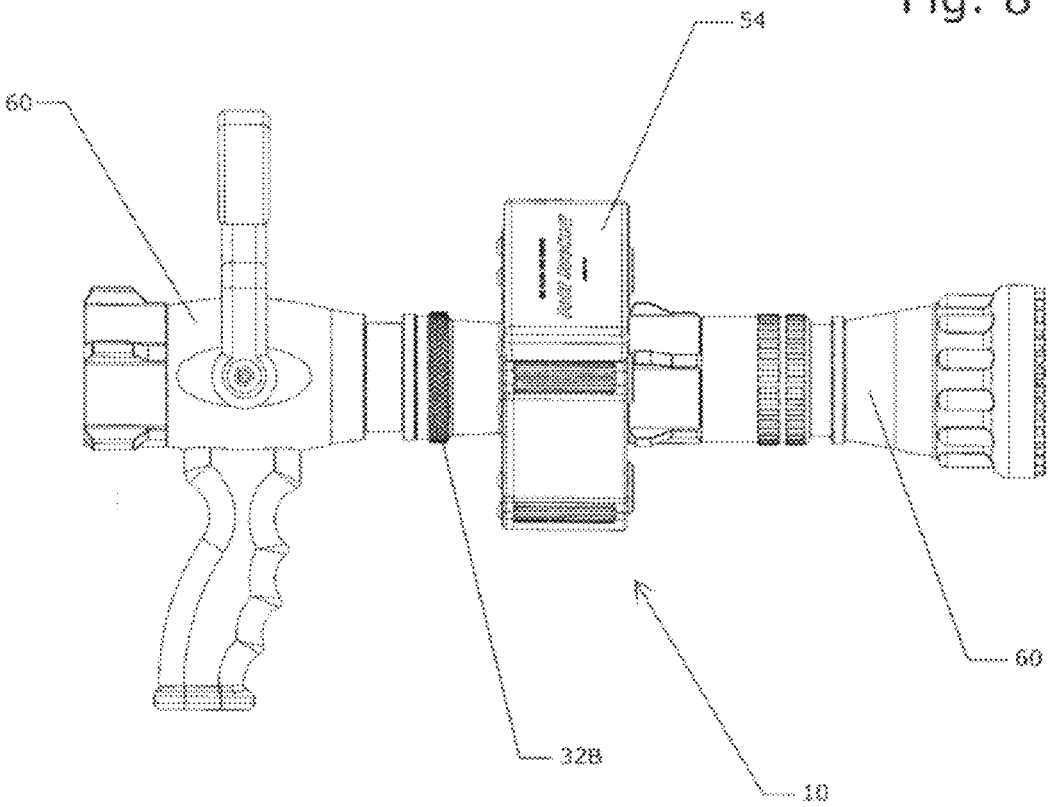
FIG. 8 is a side view of an embodiment of the device with a removable battery pack attached to a fire hose.
Figure 9:
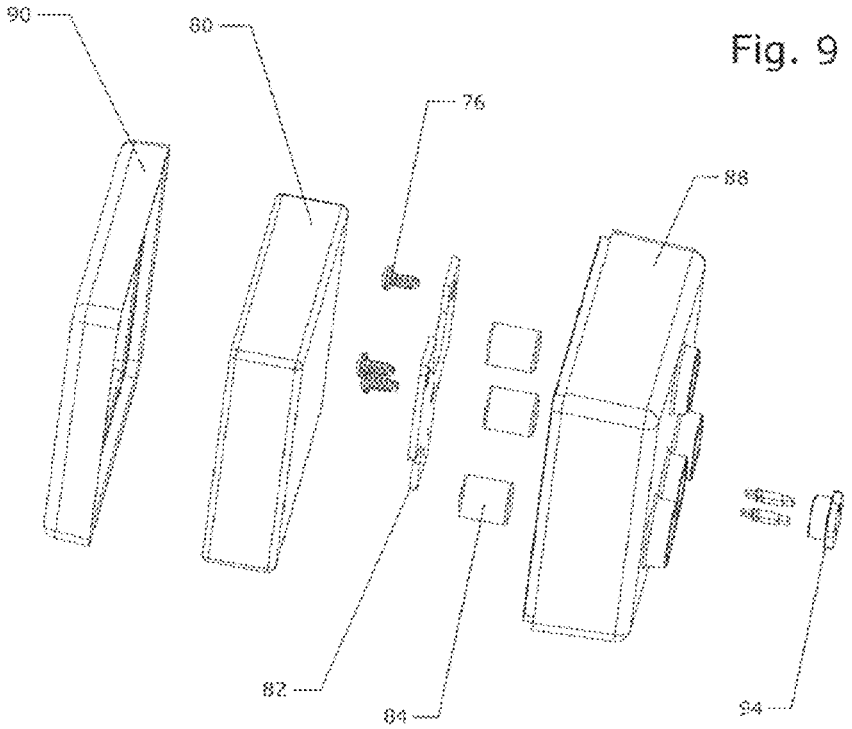
FIG. 9 is an exploded perspective view of an embodiment of the removable battery pack used with the device of the present invention.
Figure 10:
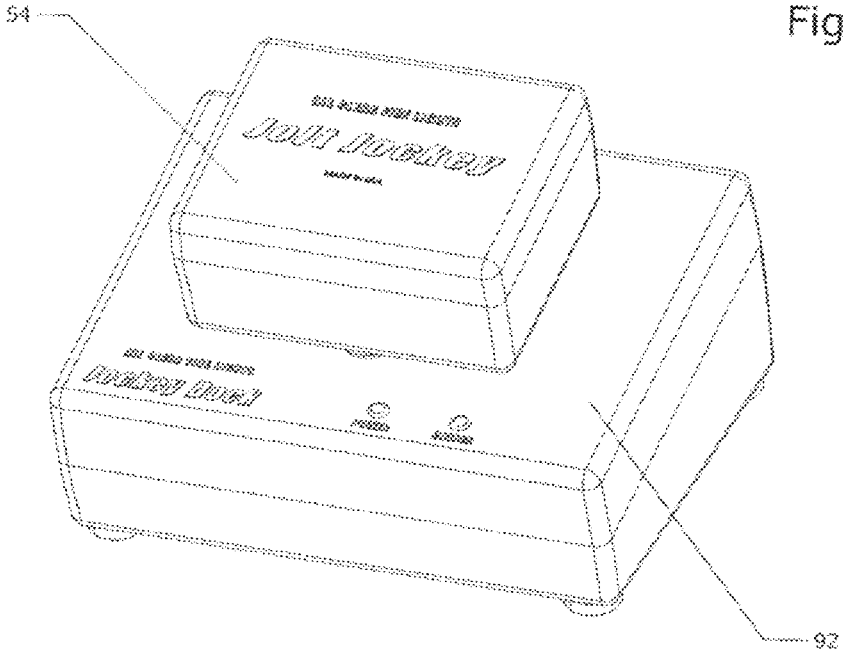
FIG. 10 is an elevated perspective view of an embodiment of the removable battery pack used with the device of the present invention attached to a charger.
Figure 11:
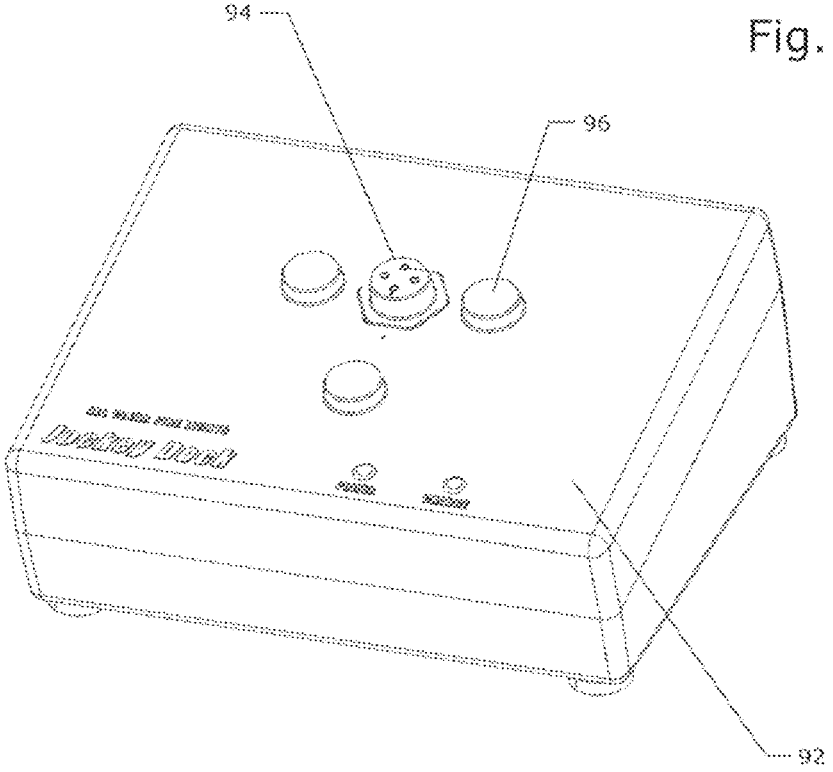
FIG. 11 is an elevated perspective view of an embodiment of the charger used with the removable battery pack.
Figure 12:
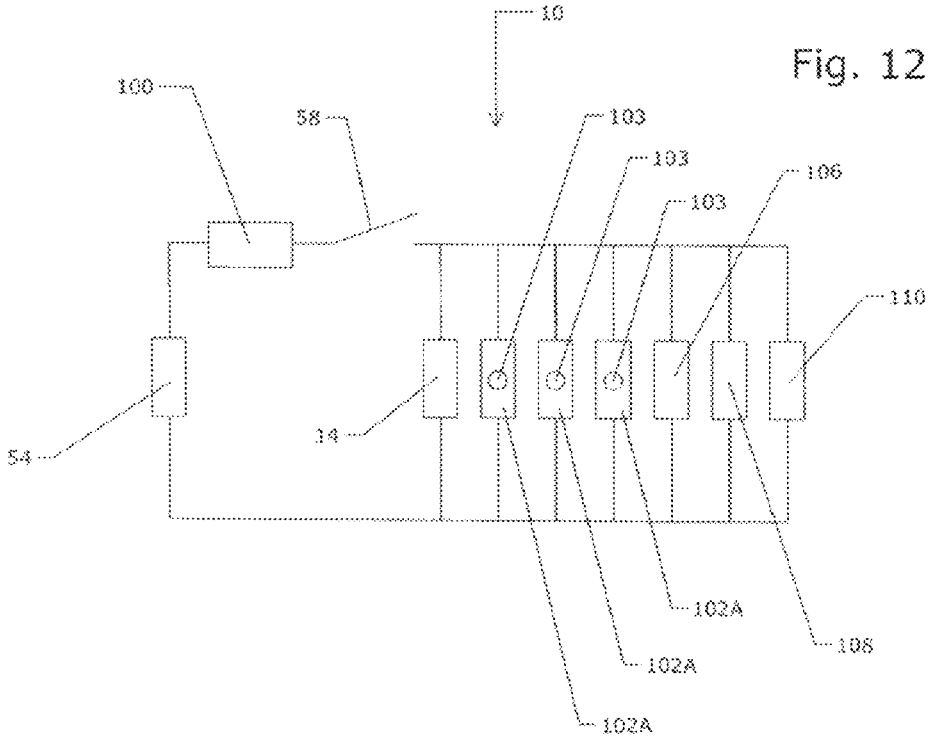
FIG. 12 is a block diagram of an embodiment of the electronic circuit used in the present invention.

Firefighting personnel will most typically use the present invention during a structure fire to advance into and through the structure. In operation, a firefighter would use the device at the nozzle end of a hand line to illuminate the firefighter's path and search the structure and apply a burst of water and/or other extinguishing agent or propellant from the attached hose. Under these operating conditions, the device 10 will see a temperature of at least 500° F. for 15 minutes, which is two and a half times the specified maximum temperature for typical batteries known in the art. Degraded battery performance not only subjects most electronics devices to failure but also exposes firefighting personnel to unacceptable risks of injury or death.

Standard thermal management strategies for devices under these extreme conditions involve components, assemblies, and constructions to manage heat generated by the power dissipation of electrical components. Standard thermal management generally includes contact of electrical components or the component packaging with at least one heat sink component or structure that conducts heat away from the electrical components to be dissipated through either conduction or radiation. This standard strategy is effective because the ambient air temperature is lower than that of the electrical components. Standard thermal management strategies are however unacceptable for fire-fighting environment, which demands a different strategy.

Contrary to the normal operating conditions that enable standard thermal management strategies to work, the ambient air temperatures during a structure fire are extreme and render standard thermal management strategies inappropriate. For example, flashover (i.e. the immediate combustion of flammable materials due to extreme heat), is reached when the average upper gas temperature in the room exceeds about 600° F. Prior to flashover, there may be flame temperatures of over 900° F. in certain areas although wide spatial variations are possible. Peak fire temperature in a room or structure fire is estimated to be around 1200° F., although a typical post-flashover room fire will more commonly be 900-1000° F.

The temperatures present in a fire can damage electronics and particularly affect the performance of batteries. Temperatures above 90° C. (or 194° F.) adversely affect battery performance. The present invention provides a significant improvement over the prior art in the field of fire-fighting tools and technology.

The present invention significantly deters battery failure due to extreme temperatures. The extreme temperatures will be absorbed by the housing and thermally conducted inwards towards the one or more internal batteries 81. If standard thermal management strategies were employed, exposure of the internal batteries 81 to the heat conducted inward would adversely affect performance of each internal battery 81 and the device. The present invention protects against heat-induced damage or reduced battery performance.

As shown in FIGS. 5C and 14-16, the presently preferred invention includes one or more internal batteries 81 encased in a cup 39, with an insulating ring 41 covering the back side and a cover 40 isolating in the housing interior apart from the LED light sources that are mounted on the printed circuit board 38, which is positioned in the housing interior against the front plate 18. The cup 39 is preferably high temperature plastic. The insulating ring 41 is preferably a ceramic fiber insulating plate, which acts as a heat shield. And the cover 40 is preferably silicone potting. It is also preferable that the cup 39 touches the interior side wall 21, given that the interior side wall 21 is water-cooled by the fluid flowing through the center of the device 10.

The cup 39 and the cover 40 each have a depth at least as great as internal battery 81 and have one or more battery-sized compartments constructed therein for receipt of internal batteries 81. The internal battery 81 is placed into the battery-sized compartments in the cup 29 and the cup is placed into the cover 40 and the insulating ring 41 is brought into contact with the cover 40 to enclose and isolate the internal batteries 81 from the printed circuit board 38 and the housing front and exterior side walls. A gasket 43 made from silicone is preferred between the insulating ring 41 and the locking plate 42.

Based on thermal measurements in beta testing procedures, the device 10 has been able to sustain temperatures of at least 1000° F. for 20 minutes, which is believed due to the isolation and insulation of the batteries by the cover 40 & insulating ring 41. The present invention protects internal batteries 81 against the extreme temperatures present in a fire fighting environment, which likely extends the life of the batteries, preserves the usefulness of the device 10 and potentially protects against injury or death of firefighting personnel due to device failure.

When subject to oven testing, the device 10 confirmed the findings in the field. During oven testing, the device 10 was heated in an oven at 350° F. for 30 minutes and the temperature of different internal parts was measured at 5 minute intervals. The device 10 was tested two ways: (1) without any fluid running through the device 10 and (2) with 85° F. fluid running through the device 10. The results showed that the battery temperature stayed well under 200° F. after thirty minutes at 350° F. —even without any fluid running through the device 10. Isolating the battery allows the battery to function as required despite the extreme temperature conditions.

In addition, by having the circuit board 38 physically touch the housing 12, the circuit board 38 was able to stay well below 200° F. after thirty minutes at 350° F. —even without being "isolated" in potting material like the batteries. Putting the circuit board 38 in thermal contact with the interior side wall 21 allows the circuit board 38 electronics to dissipate heat to the housing 12, which can be cooled by extinguishing agent flowing through the central opening of the device 10 from a fire hose. Placing the electronic circuit board 38 in contact with the housing permits the electronic components to be indirectly cooled despite extreme temperatures. Isolating the battery and placing the circuit board 38 in thermal communication with the housing creates a two-tier thermal structure that is counterintuitive in light of the known teachings in the art.

Referring to the figures, embodiments of the present invention (hereinafter device 10) are shown. The device 10 may be can be affixed to a fire nozzle, fire hose, or any series of hose couplings utilized during field firefighting operations. In addition, the device 10 can be mobile, removed from a fixed tool or hose, and carried by the fire fighter/emergency responder by means of a quick-attach assembly and carrying strap. The device 10 can be affixed to a fire engine (i.e. stang gun), ladder truck (i.e. ladder pipe), or other emergency vehicle.

The device 10 may be configured to securely fit between a fire nozzle 60 and fire hose coupling 62. Alternatively, the device 10 may be positioned between two fire hose couplings 62. Additionally, the device 10 may be attached to a water discharge outlet on a fire engine/ladder truck. The device 10 is designed to not impede the flow of extinguishing agent or to be obstructive when moved around the fire ground when the device 10 is positioned between the fire nozzle 60 and fire hose coupling 62 or between two fire hose couplings 62. Likewise, the device 10 will not impede the flow of extinguishing agent when attached to a water discharge outlet on a fire engine/ladder truck.

The device 10 may have a housing 12. The housing 12 may be used to store and house a plurality of lighting fixtures 14. The preferred lighting fixtures 14 each comprise a light source unit 32 and a columnar shape; the columnar shape positioned between the light source unit 32 and a lens 34. The lighting fixtures 14 may be used to illuminate the fire ground and guide the firefighter as the firefighter advances the hose lines. The housing 12 may further be used to store and house one or more visual indicators 16. The visual indicators 16 may be used to provide warnings to the firefighters about current operating conditions. The housing 12 may be constructed of a material that is lightweight, durable, heat resistant, cold resistant, water resistant, and able to function flawlessly in the demanding environments occupied by fire fighters in the course of their work.

The housing 12 may be formed of different geometric shapes. In the present embodiment, the housing 12 is circular in shape. A circular shape housing 12 may provide the least amount of resistance when moving the fire house with the device 10 attached. However, the circular shape is shown as one embodiment, and should not be seen in a limiting manner.

The housing 12 may be comprised of a front plate 18. An exterior side wall 20 may be formed around an outside perimeter of the front plate 18. An interior side wall 21 may be formed around an inside perimeter of the front plate 18. The exterior side wall 20 may be formed to extend up from the front plate 18 there by forming a hollow interior section 22 of the housing 12. The interior section 22 may be used to store and house the plurality of lighting fixtures 14 as well as electronics for one or more visual indicators 16.

The housing 12 may have a toroid-shaped cover 40. The cover 40 may be positioned over the interior section 22 of the housing 12. Thus, the cover 40 may be used to enclose the interior section 22. A locking plate 42 may be used to secure the cover 40 to the housing 12. The locking plate 42 may have one or more securing members 44. The securing members 44 may be used to secure the cover 40 to the housing 12. Grooves or slots located on the interior of the cover 40 are configured to slidably engage electronic circuitry 70. More specifically, the cover 40 has a slot surface 41 that complements or matches the exterior shape of the electronic circuitry 70, including at least one interior battery 81 so that the electronic circuitry 70 can slidably engage with the slot surface 41. Placing electronic circuitry 70 in the slots radially isolates the electronic circuitry 70 from the housing 12 and the exterior of housing 12. See FIG. 5C, which illustrates an exploded view of a preferred embodiment. The cover 40 also having an outside perimeter edge or shape that complements or matches the hollow interior side wall of the housing 12.

In accordance with one embodiment, the securing members 44 may be a plurality of screws 44A. As shown in the figures, one or more openings 46 may be formed around an outer perimeter of the locking plate 42. Each opening 46 may be aligned with a corresponding channel 48 formed on the housing 12. Each channel 48 may be formed on the side wall 20. Each channel 48 may be threaded so as to engage a corresponding screw 44A.

The front plate 18, the plate member 38, the cover 40, and locking plate 42 may each have a central opening 30A, 30B, 30C and 30D respectively, formed there through. The central openings 30A, 30B, 30C and 30D may be used to allow the extinguishing agent to enter and flow through the housing 12.

A pipe 50 may be positioned through the housing 12. The pipe 50 may be used to allow the extinguishing agent (or fluid) to pass through the housing 12. In accordance with the embodiment depicted in the figures, the pipe 50 may be positioned through the central openings 30A, 30B, 30C and 30D formed through the front plate 18, the plate member 38, the cover 40, and locking plate 42 respectively. The pipe 50 may be used to allow the extinguishing agent (or fluid) to enter and flow through the housing 12.

The pipe 50 is designed to not impede the flow of extinguishing agent or to be obstructive when moved around the fire ground when the device 10 is positioned between the fire nozzle 60 and fire hose coupling 62 or between two fire hose couplings 62. The pipe 50 may have a coupling 52 located on each end. The coupling 52 may be used to connect the pipe 50 between the fire nozzle 60 and fire hose coupling 62 or between two fire hose couplings 62. The coupling 52 may be a threaded end 52A, a threaded hose coupling 52B, or the like. An optional laminar flow insert 53 can be used to control flow through the pipe 50. The above is given as an example and should not be seen in a limiting manner. Other couplings may be used without departing from the spirit and scope of the present invention.

The pipe 50 may further have a pair of ring members 72. A ring member 72 may be positioned on each end of the pipe 50. The ring members 72 may be used to secure the pipe 50 within the housing 12.

Lighting Embodiment

The device 10 has the ability to improve situational awareness on emergency scenes with integrated high-power LED lighting. The device 10 has the ability, through properly focused lenses, to illuminate a hose/water stream. Any fluid flowing from a mobile hand line, fixed ground monitor position, fire engine nozzle, fire ladder nozzle, or mobile apparatus can be illuminated for the distance of its travel. This illuminated fluid can facilitate easier application of water/foam in limited visibility environments on the emergency scene. The UV nature of the emitted light from the device 10 affixed to a hand line on the interior of a structure has been found to illuminate existing water vapor in the environment adding additional visibility.

One of the functions of the electronic circuitry 70 may be to provide a high-power, LED lighting system able to illuminate the fire ground and guide the firefighter as the firefighter advances hose lines. The lighting fixtures 14 may be programmed to automatically turn off at 15 minutes to save on the life of the external power supply 54 should the nozzle be unattended and acts as a timer for work cycles. Whether inside a structure, outside on a wild land fire, or on the scene of an auto accident the lighting fixtures 14 may have a minimum of two settings, high/low. The choice of light intensity will not affect the light timing as it is independent of the fire fighter choice of light intensity. Timing requirements can be altered or customized per individual fire department specifications and needs.

One or more light openings 24 may be formed through the front plate 18. The light openings 24 may be formed around the perimeter of the front plate 18. The light openings 24 may be used to position the one or more lighting fixtures 14 within the housing 12. One or more light slots 26 may also be formed within the side wall 20. The one or more light slots 26 may be formed next to and adjacent a corresponding light opening 24. The light slots 26 may be used to allow easy removal of a corresponding lighting fixture 14. A lighting fixture plate 28 may be positioned within each light slot 26 to secure the lighting fixture 14 within the light slot 26 and corresponding light opening 24. The lighting fixture plate 28 may be designed to be pressure fitted within the light slots 26. Thus, by applying pressure to the lighting fixture plate 28, one may be able to release the lighting fixture plate 28 from within the light slots 26, thereby allowing one to remove the corresponding lighting fixture 14.

As stated above, a plurality of lighting fixtures 14 are positioned within the housing 12. As shown in the figures, each lighting fixture 14 may be comprised of a light source unit 32.

Each light source unit 32 may be a high-power LED lighting fixture that may be able to illuminate the fire ground and guide the firefighter as the firefighter advances hose lines. For the purposes of this specification, "high-power" LED is defined as an LED component that is greater than 0.20 watts. A lens 34 may be positioned in front of each light source unit 32. The lens 34 may be used to focus and/or direct the light from the light source unit 32. The lens 34 may also be used to protect the light source unit 32. A lens housing 36 may be used to secure the lens 34 in front of each light source unit 32. A reflector 35 may be used to redirect the light to minimize scattering. A plate member may be used to secure the lighting fixture 14 within the interior section 22 of the housing 12.

This may allow the lighting fixtures 14 to be directed to illuminate the extinguishing agent exiting the device 10. This may help firefighters determine if the extinguishing agent exiting the device 10 is being properly directed in the right area/location to extinguish the fire.

Preferred Embodiment Unexpectedly Achieves a "Fiber Optic" Effect

The preferred optic embodiment shown in FIGS. 18-25 has been found by field observation to create a "fiber optic" effect when fluid is flowing through the nozzle. As shown in the photos below, an extinguishing agent exiting the device housing appears to capture and reflect light in its stream similar to the way a fiber optic waveguide captures and internally reflects light within its body. The ability to capture and reflect light in a stream of an extinguishing agent produces unexpected results that benefit firefighting operations.

This illuminated fluid can facilitate easier application with water/foam in limited visibility environments on the fire scene. The UV components of the light emitted by the lighting fixtures 14 are also of utility in illuminating the scene without back scattering (glare) in the visible spectrum. UV light emitted does scatter in the smoke, but such scatter is invisible to the human eye such that fluorescent and phosphorescent objects within the smoke-filled environment, including reflective sections on fire fighters' turnout gear, provide visual cues and references to the fire fighter.

Based on field observation, preferred optics package greatly exceeds mere flashlight performance in firefighting operations. First, fire-fighting environments are often dark and smoke-filled. In low light conditions fire-fighters must often direct extinguishing agent at a target without knowing exactly where it is being applied. The invention solves this problem and allows a firefighter to see and thus aim a lighted stream of extinguishing agent from a firefighting nozzle at an intended target.

Images 1 and 2 above, for example, shows a lighted stream of extinguishing agent (e.g. water) exiting a nozzle coupled to a device 10. The device brightly illuminates the full length of steam of extinguishing agent from the nozzle to the fire despite the low level light conditions. Image 2 shows an arced stream of extinguishing agent as a firefighter compensates for gravity while aiming the stream of extinguishing agent. These benefits are not provided by ordinary flashlights.

The device also provides unexpected benefits inside structures that are on fire. Light projected into a firefighting environment encounters combustion products such as smoke or gases. Light from an ordinary flashlight is scattered, reflected or blocked creating glare and limiting its usefulness. An extinguishing agent directed through the device however, "punches" a path through clouds of combustion product through which light from the device may project either alongside or within the extinguishing agent.

As an example, Image 3 (below) illustrates a firefighter directing the device inside a structure filled with combustion products. Light from the device is scattered and dimmed from the combustion products creating glare. Image 4 (below) captures the scene after opening the valve on the firefighting nozzle. The claimed device creates a very bright illuminated stream of extinguishing agent that pushes though clouds of the combustion product to better illuminate an interior structure and improve visibility.

The capability of pushing through clouds of combustion products would be particularly useful if an individual was separated from others in a darkened space without a reliable light source. A firefighter with the device could push an illuminated stream of extinguishing agent into the darkened space to provide light for the separated individual and facilitate their escape or rescue. The described attributes exceed the performance expected from the mere combination of elements.

The device performs in the described manner producing the unexpected benefits due to its particular combination and interrelation of elements. The position of the light unit openings at the outer perimeter wall of the housing provides an exemplary angle from which light emitted from LEDs may penetrate the stream of extinguishing agent. The effect is optimized by the use of focusing lenses that direct the light from the light unit openings to intersect with the stream of extinguishing agent exiting the housing. Light intersecting the stream of extinguishing agent exiting the housing penetrates, reflects within, and illuminates the extinguishing agent exiting the housing.

Figure 25:
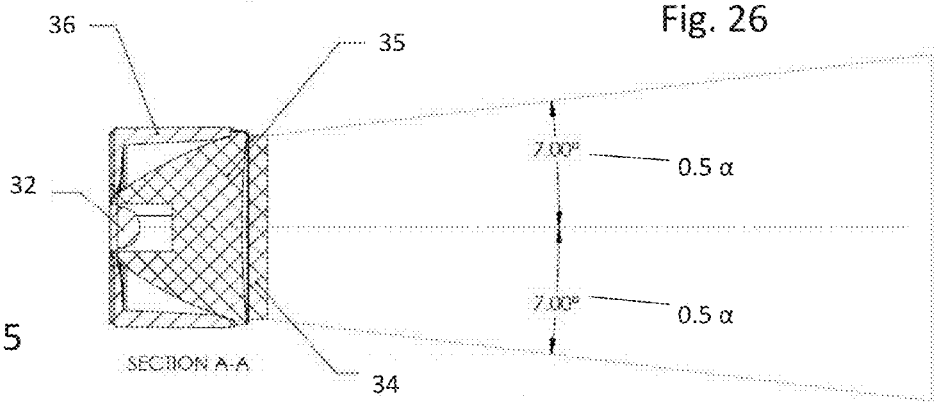
FIG. 25 is a sectional view of FIG. 24 taken along cut line A-A.
Figure 27:
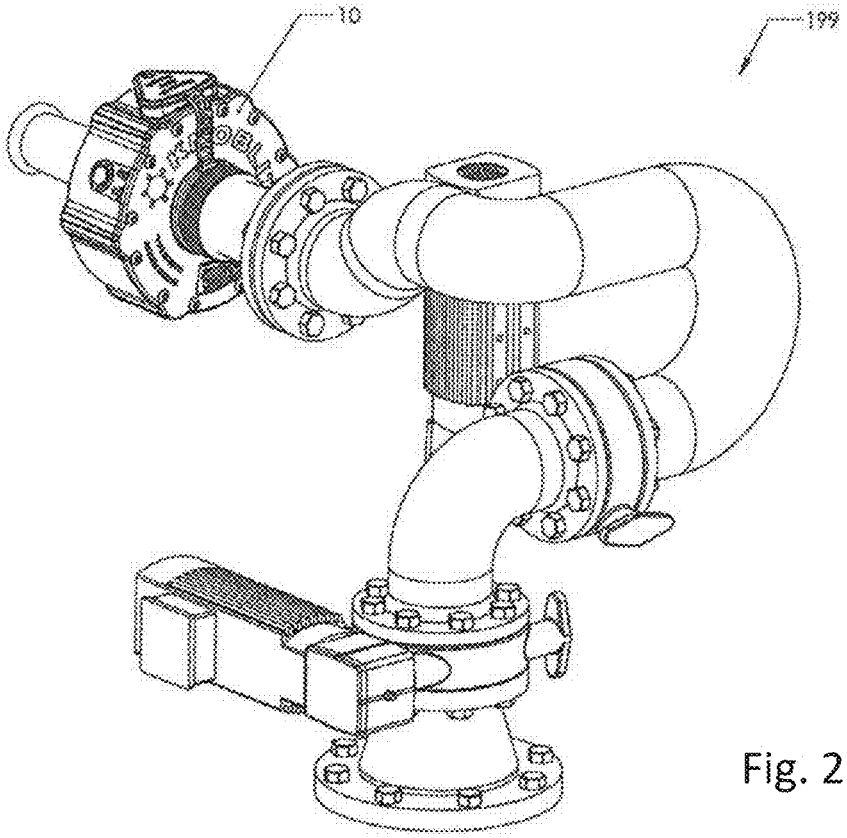
FIG. 27 is a perspective view of an embodiment of the device of the present invention attached to a fire engine water gun.
Figure 28:
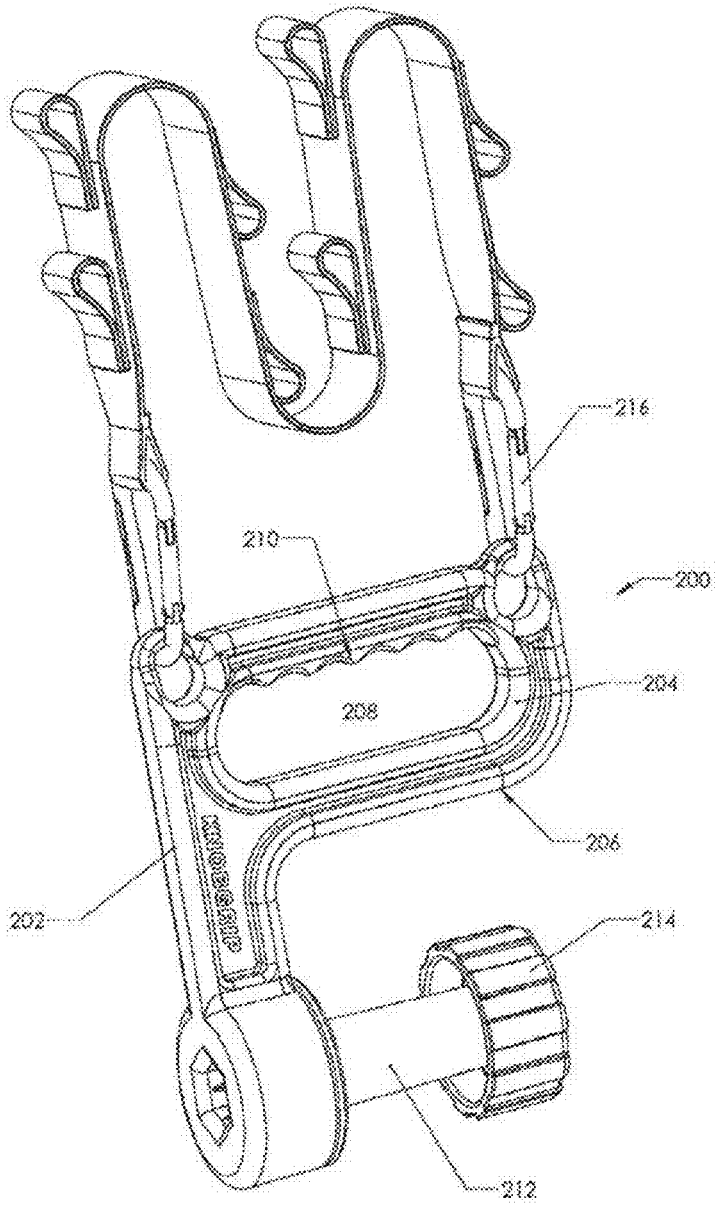
FIG. 28 is a perspective front view of an embodiment of a carrying device used with the device.
Figure 29:
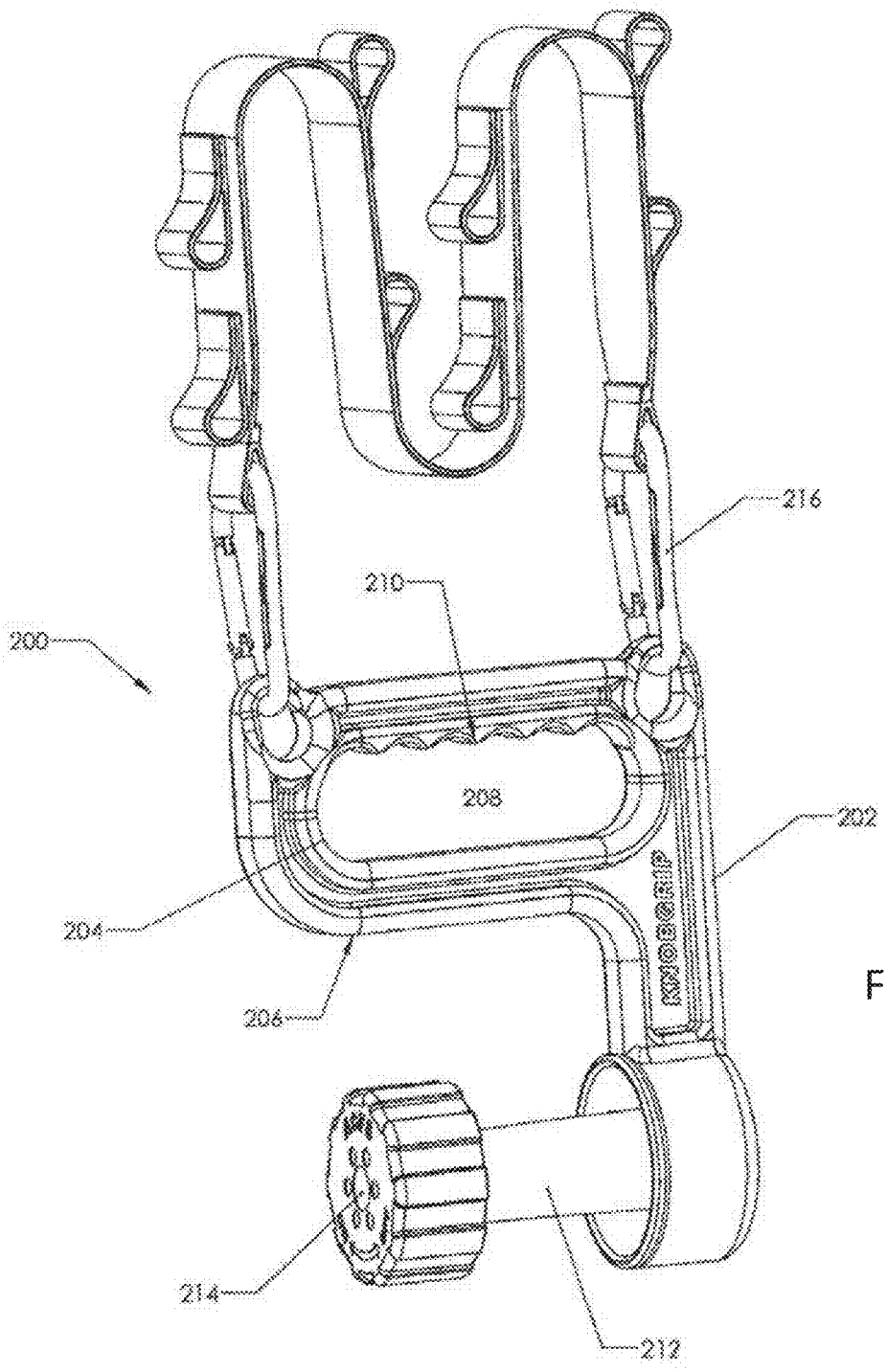
FIG. 29 is a perspective rear view of an embodiment of the carrying device used with the device.
Figure 30:
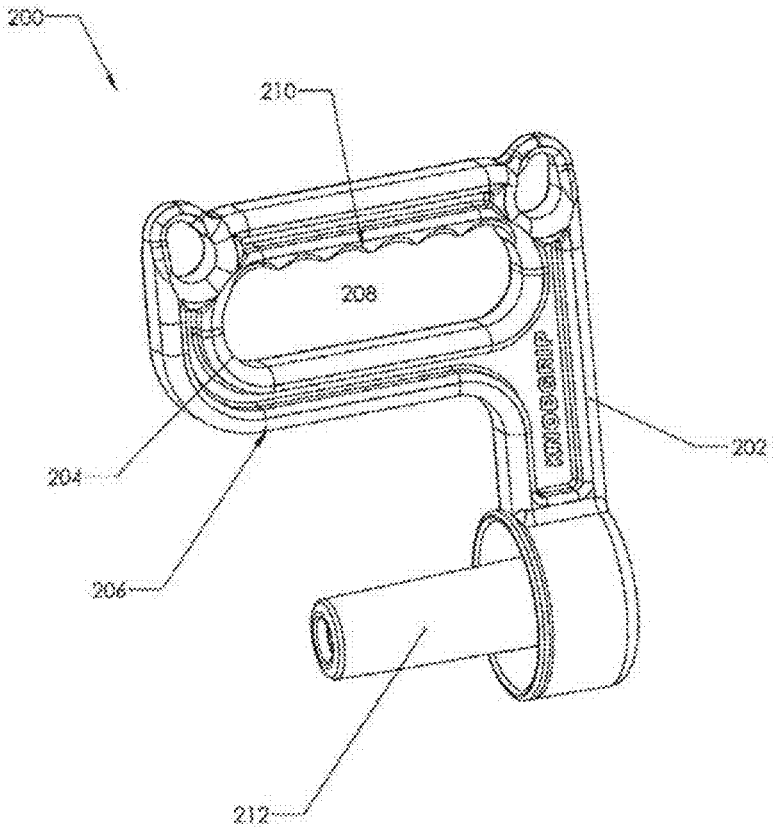
FIG. 30 is a rear view of an embodiment of the carrying device used with the device with an end cap removed.
Figure 31:
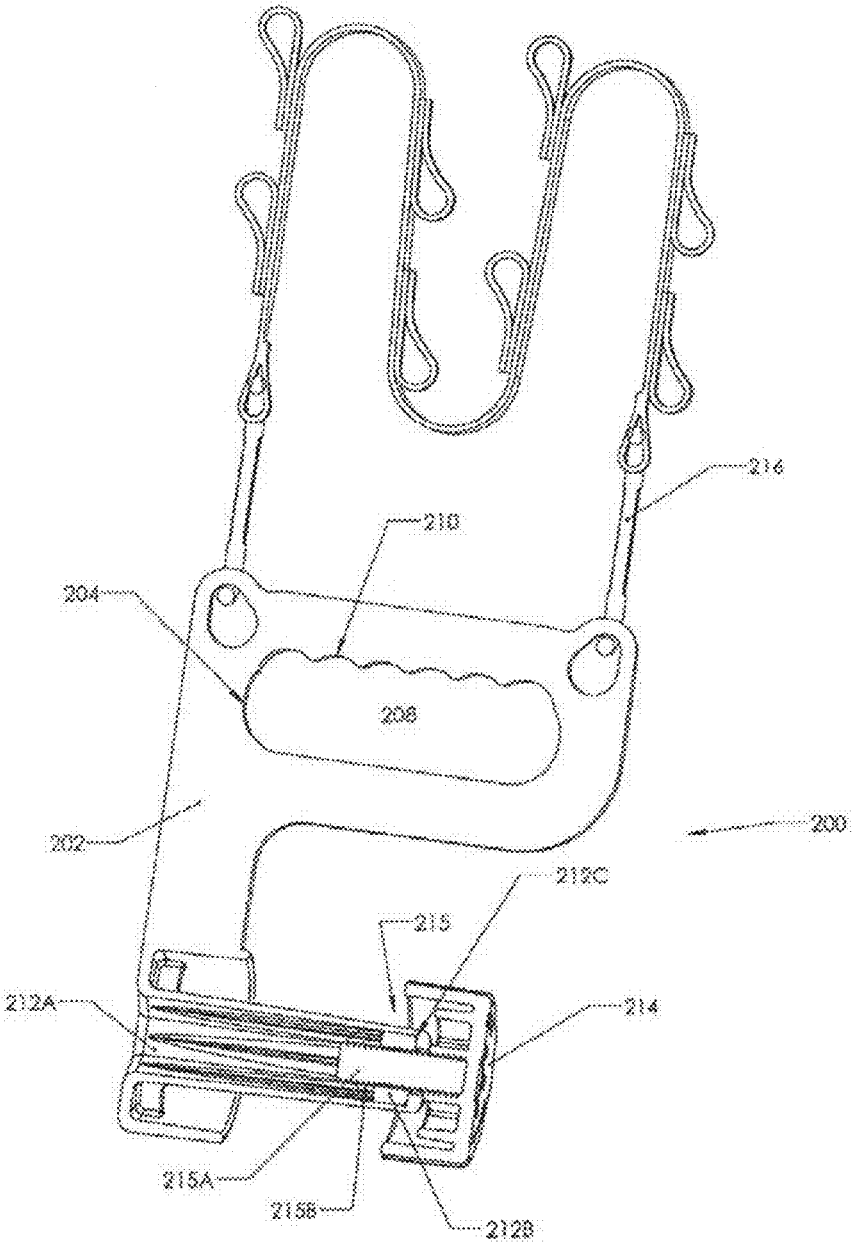
FIG. 31 is a cross-sectional view of an embodiment of the carrying device used with the device.
Figure 32:
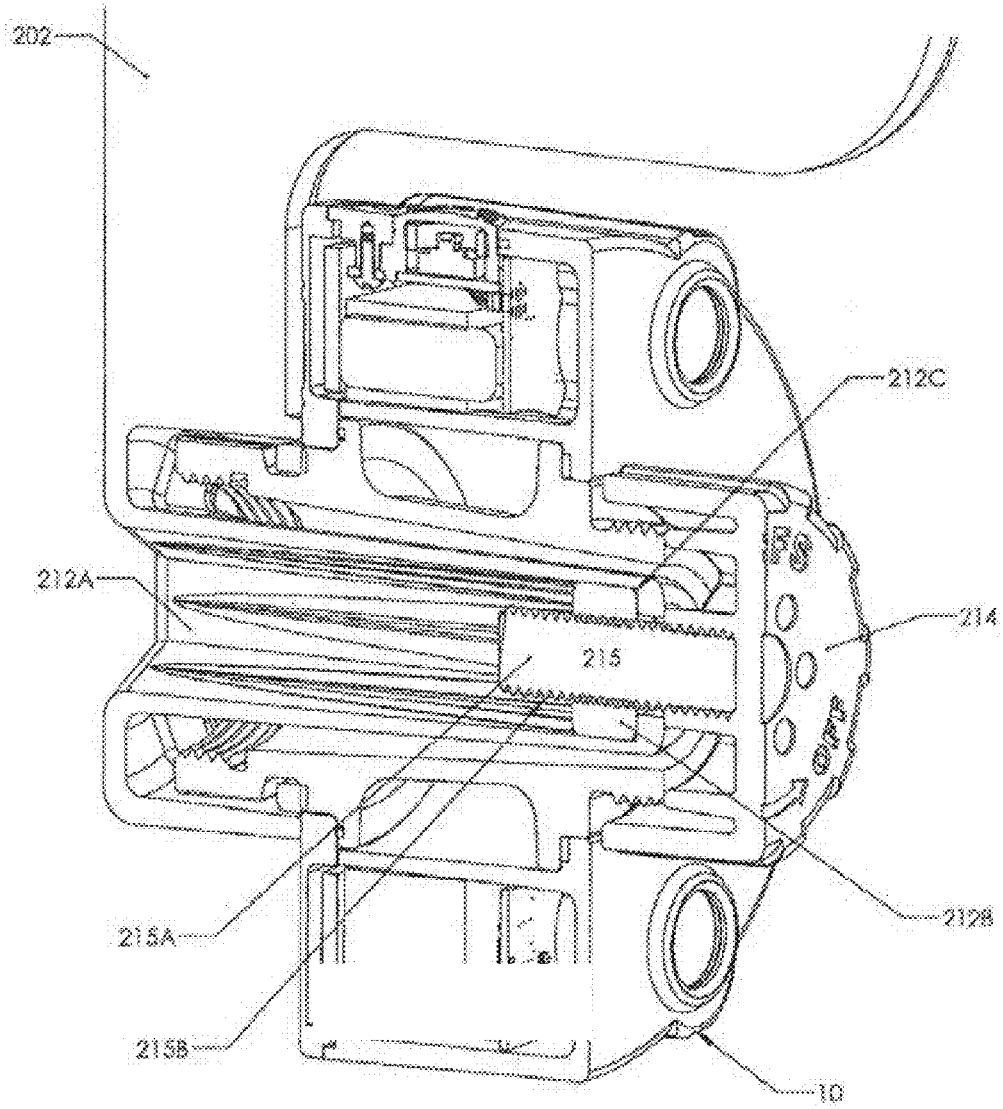
FIG. 32 is a magnified cross-sectional view of an embodiment of the carrying device used with the device with the device attached.
Figure 33:
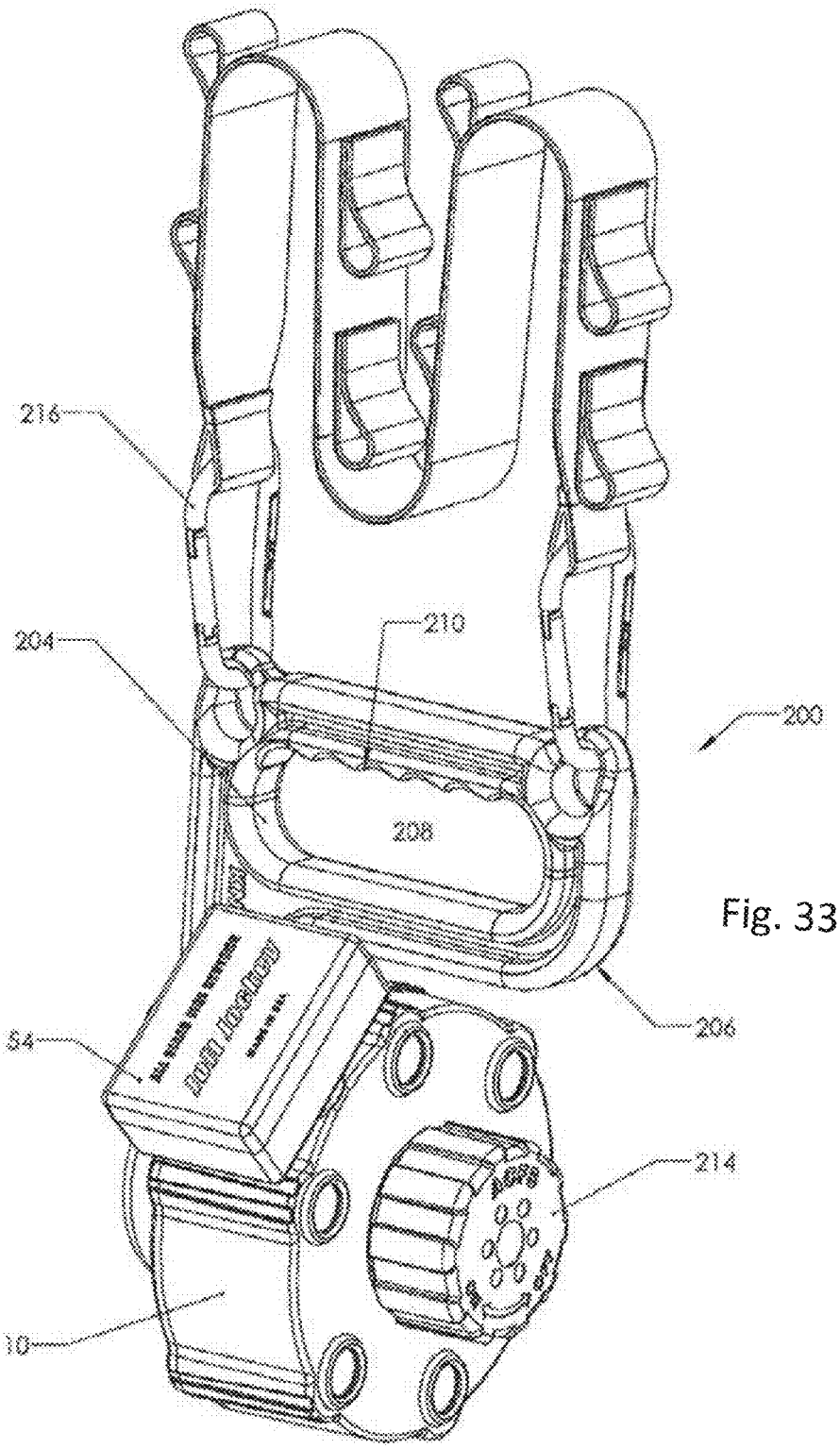
FIG. 33 is a perspective front view of a carrying device used with the device with the device attached.
Figure 34:
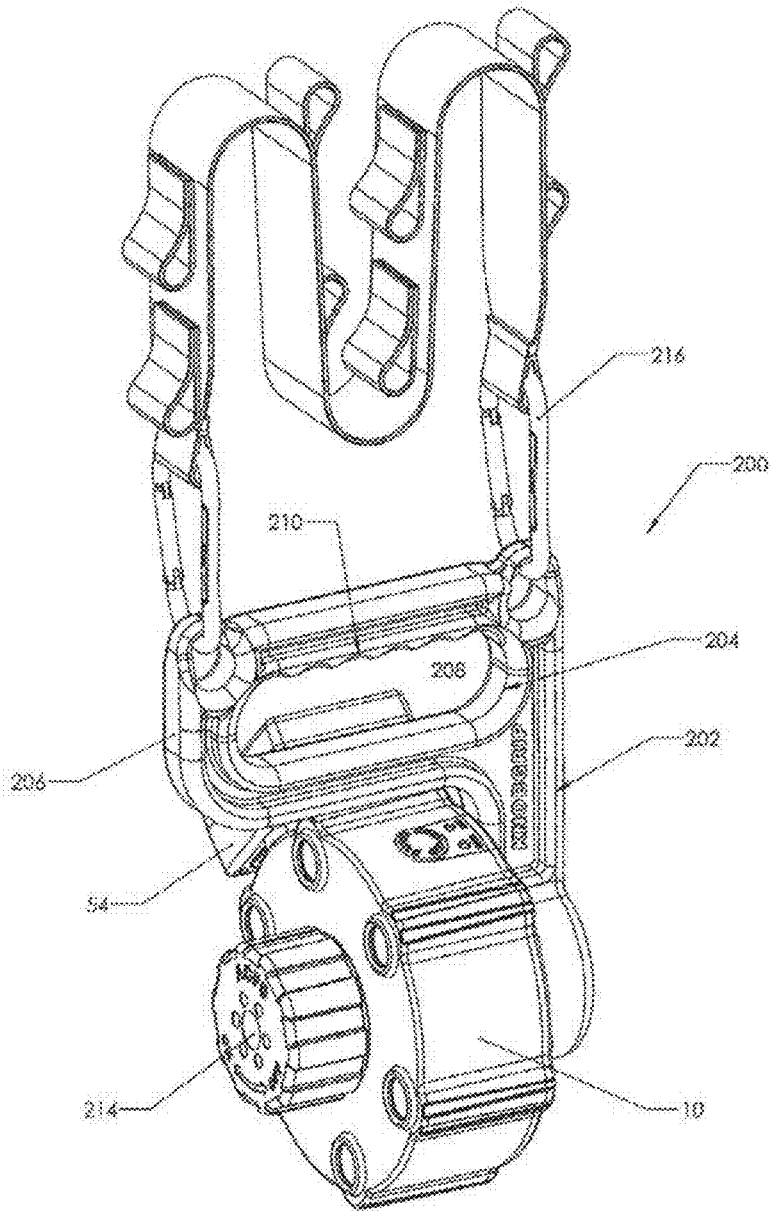
FIG. 34 is a perspective rear view of a carrying device used with the device with the device attached.

FIGS. 18-25 illustrate the preferred optics package that has been found to create a "fiber optic effect." The preferred lighting fixture 14 has a viewing angle $\alpha$ of 14°, a real spot lens, an efficiency of 93%, and a cd/lm of 7.6. A viewing angle $\alpha$ as small as 7° and as wide as 21° has been found to create some fiber optic effect, but a 14° viewing angle has been found to be optimum given the dimensions of the device 10 shown in FIGS. 18-25. As shown in FIG. 25, the viewing angle $\alpha$ is twice the number of degrees from horizontal at which the luminous intensity drops to half the peak value, where the peak luminous intensity is measured at right angles to the surface of the LED chip. The reflector 35 is preferably made from PMMA. An example of a preferred light fixture is made by LEDil as part of its Leila family.

The preferred light source unit 32 is a high power LED lamp that light fixture that has a viewing angle of 135° and can generate 1000 lumens with 100 lumens per watt efficiency. An example of such a lamp is made by Cree, Inc. and is sold by the trade name XLamp XM-L. The preferred lens 32 is a quartz lens.

Figure 20:
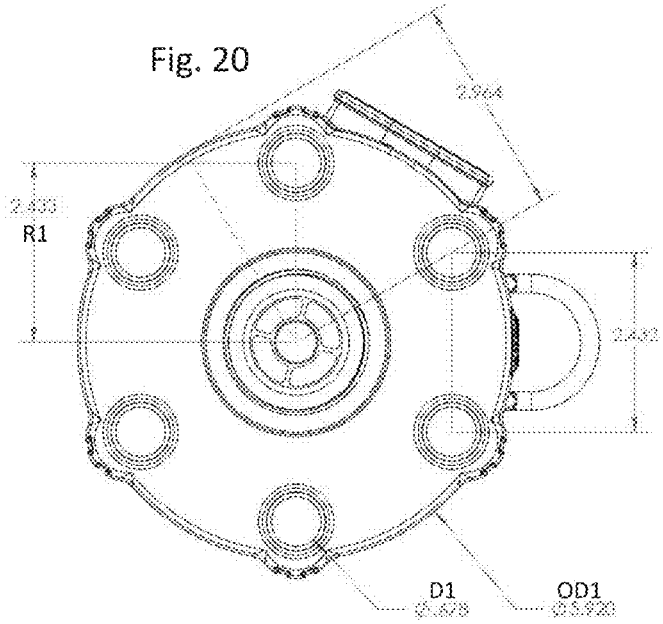
FIG. 20 is a front view of the device 10 of FIG. 17.
Figure 19:
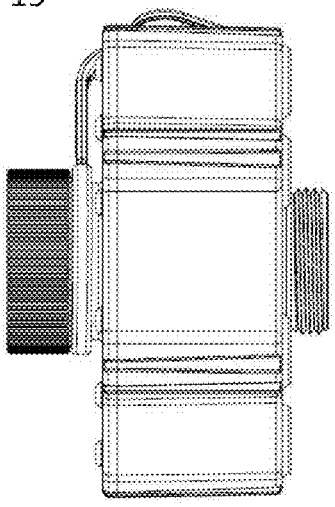
FIG. 19 is a side view of the device 10 of FIG. 17.
Figure 24:
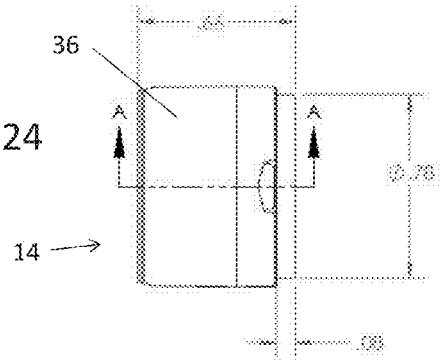
FIG. 24 is a side view of a preferred lighting fixture unit 14.
Figure 26:
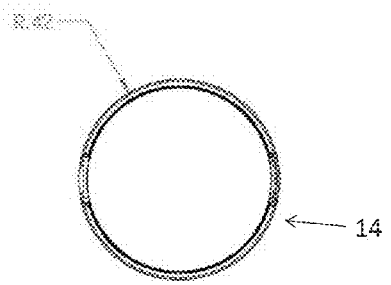
FIG. 26 is a front side view of FIG. 24.

As shown in FIG. 20 the preferred light openings 24 have an opening diameter D1 of 0.678 inches and the light opening 24 is centered a radial distance R1 of 2.433 inches from the center of the device 10, and be spaced at 2.432 inches from each other center-to-center. In this embodiment the device 10 has an outside diameter OD1 of 5.92 inches and the fluid stream passing though the center has an outside diameter FD1 of 3 inches. It is preferred that the center of each light unit opening perimeter be at least 8/10ths of the distance from the center of the fluid flow path to the outer perimeter wall. It is also preferred that the front plate be substantially circular and the diameter of the front plate is at least one and a half times larger than the diameter of the center opening and no greater than five times larger than the diameter of the center opening.

Power Supply Embodiment

As discussed in more detail below, the device 10 has its own internal power source, external power source, and charging system capable of extending operational readiness in remote locations without readily available electrical resources.

The housing 12 may have one or more contacts 56. The contacts 56 may be used to secure an external power supply 54 to the housing 12. The external power supply 54 may be used to power electronic circuitry 70 stored within the housing 12. The external power supply 54 is interchangeable so that a current external power supply 54 may be removed, and a fully charged power supply attached to the contacts 56. The external power supply 54 may also be a rechargeable power supply.

The figures show one embodiment of the external power supply 54. As may be seen in the figures, the external power supply 54 may have a battery unit 80. The battery unit 80 may be used to supply a DC power source to the electronic circuitry 70. The battery unit 80 may have a contact board 82 attached thereto. One or more securing devices 76 may be used to secure the contact board 82 to the battery unit 80. The contact board 82 may be used to attach a battery contact 84 to the battery unit 80. The battery contact 84 may be used to attach the external power supply 54 to contacts 56. This may allow the external power supply 54 to attach to the electronic circuitry 70. When in use, the battery contact 84 may contact the contacts 56 to secure the external power supply 54 to the housing 12 and to the electronic circuitry 70.

An external battery unit 80 may be stored within a battery housing 88. A lid 90 may be attached to the battery housing 88 thereby enclosing the external 80 within the battery housing 88.

In accordance with one embodiment, the external battery unit 80 is a rechargeable battery unit. One or more charging pins 92 may be coupled to one of the battery contacts 84. This may allow the charging pins to attach to a charging plug 94 of a recharging unit 92. One or more alignment pins 90 may be formed on the battery housing 88. The alignment pins 90 may be used to align the external power supply 54 onto a recharging unit 92 having corresponding alignment pins 96.

The housing 12 may store electronic circuitry 70. The electronic circuitry 70 may be positioned within the interior section 22 of the housing 12. The electronic circuitry 70 may be capable of connecting and operating a myriad of simple systems that perform functions essential to fire fighter safety.

Warning Sensor Embodiments

The current device contains several safety features that provide warnings to firefighters and assist them should they become lost or incapacitated in the course of their work. An integrated timer provides a prompt, in conjunction with standard elapsed time protocol, to remind fire fighters to continually be vigilant regarding the condition of the burning structure, personal air management, and condition/location of other fire fighters. The device 10 provides safeguards should a firefighter become separated from the hand line, disoriented, or lost due to decreased visibility. The device 10 has a hook 33 attached to the rear plate of the housing cover. Should a fire fighter be involved in a structural collapse or other life threatening situation in the hot zone, the fire fighter can secure the water flow in a hand line, disconnect the device 10 from the fire nozzle/hose, and attach the hook 33 to the fire fighter's turnout coat to provide hands-free use during egress.

A switch 58 may be coupled to the external power supply 54. The switch 58 may be used to activate and deactivate the electronic circuitry 70. The switch 58 may be located on the exterior of the housing 12. The switch 58 may be programmed to "turn on" with a 0.5 second engagement and "turned off" with a 3.0 second engagement to avoid any inadvertent termination of the electronic circuitry 70 during operation. The switch 58 may further double as a "CAP" (conditions, air, people) elapsed time warning light. Fire fighters are taught that 10 minutes of flame impingement on building structural components seriously effect construction integrity and pose serious collapse hazards to fire fighters inside structure. The switch 58 may be an illuminating switch. When activated, the switch 58 may automatically initiate a timer 100. The switch 58 may appear "green" advising fire fighters that they have been inside the "hot zone" for less than 10 minutes. At 10 minutes the switch 54 will begin blinking "red." This will remind fire fighters to address their tactical priorities:

(1) Conditions: re-evaluate the interior conditions of the structure for safety.

(2) Air: check the available air in you and your crew's SCBA bottles.

(3) People: know the location and condition of all your assigned members.

and begin to plan their egress from the structure. At 15 minutes the blinking "red" will become a solid "red." This will provide a "fire fighter off line/MAYDAY" safety feature that will keep the device illuminated to act as a beacon for fire fighters attempting to find the hand line in low visibility environments or locate lost/incapacitated fire fighters. The light function on the switch 58 can again be illuminated by engaging the switch 58 for 0.5 second.

One or more sensors/alarms 102 may also be coupled to the external power supply 54. One of the sensors/alarms 102 may be for example a hazmat monitor 102A. The hazmat monitor 102A may monitor for hazardous materials such as $O_2$, CO, $SO_2$, CN, radiation, LEL (explosion limit), and the like. The listing of the above is given as an example and should not be seen in a limiting manner. The hazmat monitor 102A may be coupled to a visual indicator 103 Thus, when hazmat monitor 102A detects a specified hazardous material, the corresponding visual indicator 103 may illuminate. The above listed sensors/alarms 102 and hazmat monitors 102A are only given as examples and should not be seen in a limiting manner. Other types of meters, atmospheric/biological monitors, and safety warning devices that enhance scene safety and fire fighter survivability may be incorporated without departing from the spirit and scope of the present invention.

Video Embodiments

The device 10 may further provide video monitoring and other sensory information capability for incident commanders at remote locations on the fire scene to evaluate the work efforts and conditions being experienced by firefighters engaged in firefighting operations. The device 10 may further provide about visual indicators about current operating conditions for the firefighters as will be discussed below The electronic circuitry 70 may further have a receiver/transmitter unit 106. The receiver/transmitter unit 106 may be used to transmit video/data collected from the electronic circuitry 70 to a desired location (i.e., command post, etc.). The receiver/transmitter unit 106 may further be used to receive video/data transmitted by another party. For example, the receiver/transmitter unit 106 may receive a command to evacuate the building transmitted by the command post. In this situation, the receiver/transmitter unit 106 may cause the electronic circuitry 70 to start flashing all visual indicators 103.

The receiver/transmitter unit 66 may further be able to receive and then transmit current health data of the firefighter. For example, a firefighter may wear one or more sensors to monitor the firefighter's health (i.e., heart rate, blood pressure, $O_2$ levels, etc. The information monitored by these sensors may then be collected and transmitted by the receiver/transmitter unit 106 to a desired location (i.e., command post, etc.).

The electronic circuitry 70 may further have a display screen 108. The display screen 108 may be used to display graphical information. For example, the display screen 108 may display information captured by the sensors 102 and or sensors on the firefighters as discussed above. The display screen 108 may display information transmitted by the command post. The above is given as examples of information that may be displayed on the display screen 108. Other information may be displayed without departing from the spirit and scope of the present invention. It should also be noted that the display screen 108 may be used for other purposes than that described above without departing from the spirit and scope of the present invention.

The electronic circuitry 70 may further have a distress button 110. The distress button 110 when activated would alert others that a firefighter is in need of help. The distress button 110 may send a signal which causes all of the lighting fixtures 14 to start flashing. The distress button 110 may send a signal to the receiver/transmitter unit 106 which may transmit a signal to a command post that the firefighter is in trouble. The above are given as examples. The distress button 110 when activated may alert others that a firefighter is in need of help in other ways without departing from the spirit and scope of the present invention.

The device 10 may have one or more video cameras 112. The video camera 112 may be able to provide streaming video, still photographs, or a combination of the aforementioned. The video camera 112 may further have audio capability to record audio signals around the device 10. The video camera 112 may be mounted to a lighting fixture 14. Alternatively, the video camera 112 may be mounted on other areas of the device 10. The video camera 112 should be mounted on the device 10 to have an unobstructed view.

Because of the enhanced lighting feature of the device 10, the video camera 112 may be able to record the actions of and conditions experienced by fire fighters engaged in firefighting operations. The video camera 112 may be coupled to the receiver/transmitter unit 106. This may allow one to transmit audio/video data captured by the video camera 112 to a desired location (i.e., command post, etc.). The transmitted audio/video data may then be used by emergency scene supervisors/trainers/educators to evaluate and recommend behavior conducive to enhanced scene safety and fire fighter survivability.

The device 10 may further have a communication module 116. The communication module 116 may allow the fire to communicate scene with emergency supervisors/trainers/educators. The communication module 116 may be coupled to the receiver/transmitter unit 106. The receiver/transmitter unit 106 may allow audio signals to be transmitted to and from the device 10. In accordance with one embodiment, the communication module 116 may have an audio port. The audio port may allow one to connect a headset to the device to allow one to transmit and receive audio signals from the headset.

Figure 13:
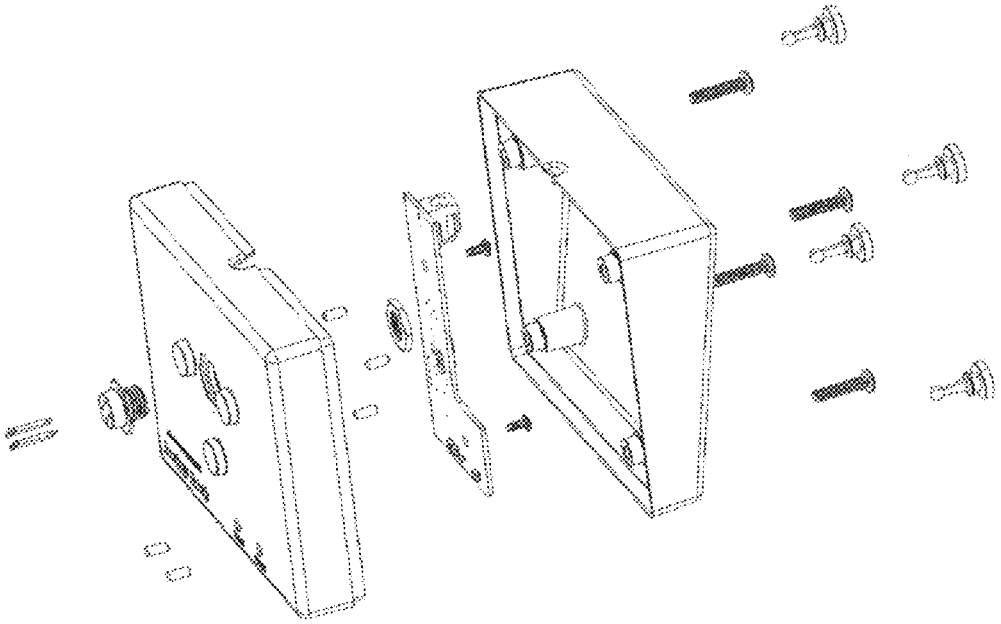
FIG. 13 is an exploded perspective view of an embodiment of the charger used with the removable battery pack.
Figure 14:
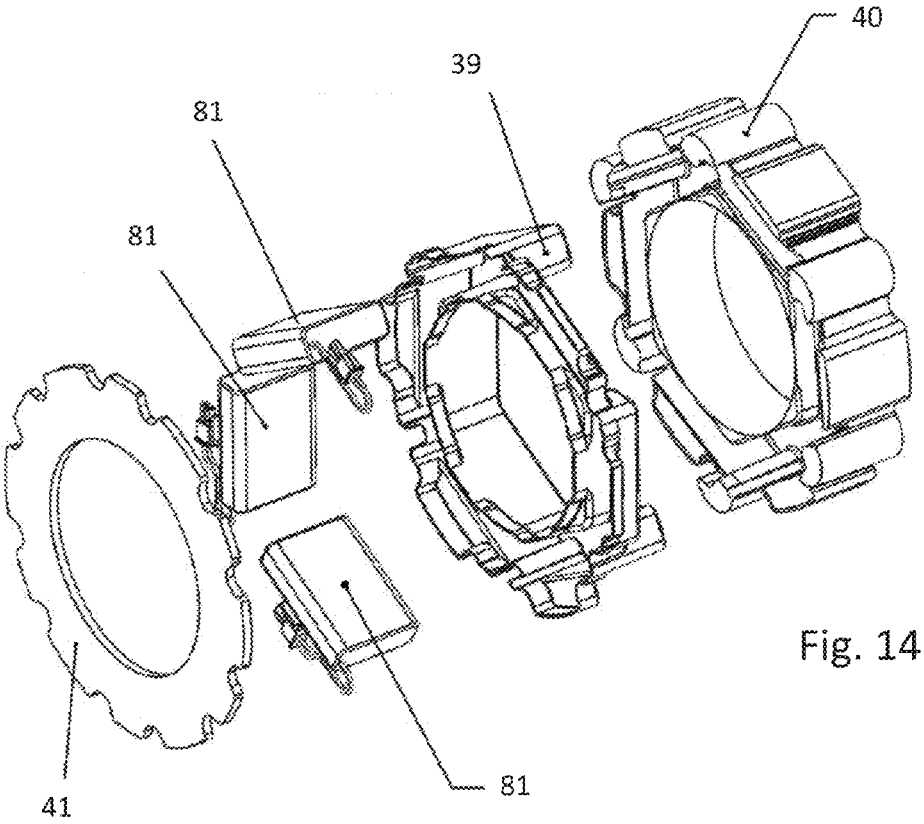
FIG. 14 is an exploded perspective view of the preferred cup 39, cover 40 and insulating ring 41 which enclose electronics 70 and internal battery 81.
Figure 15:
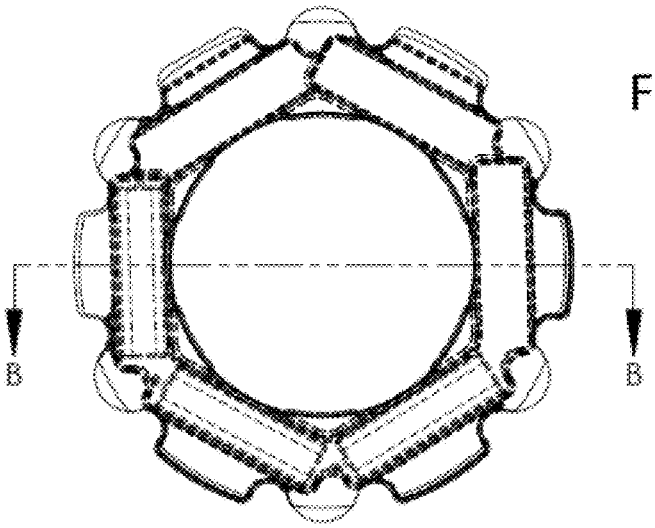
FIG. 15 is a top view of the embodiment shown in FIG. 14.
Figure 16:
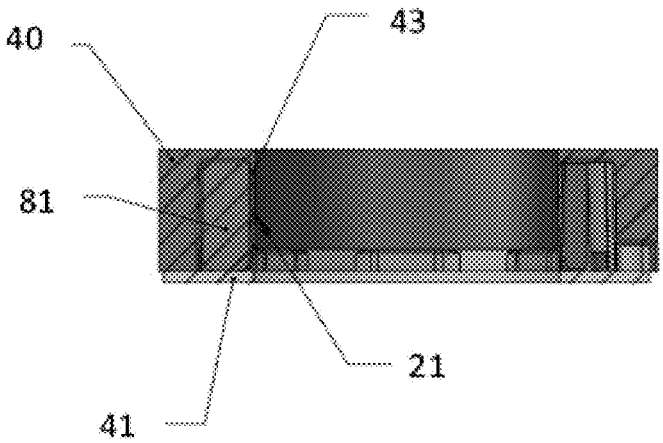
FIG. 16 is a sectional view taken along cut line B-B of FIG. 15.
Figure 18:
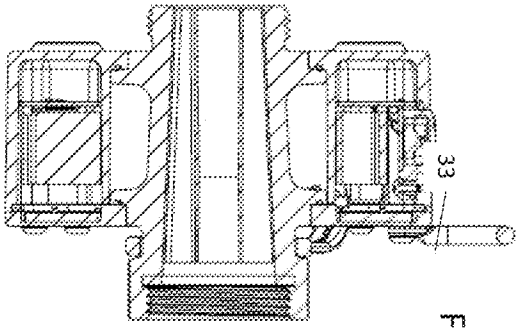
FIG. 18 is a sectional view of FIG. 17 taken along cut line A-A.
Figure 17:
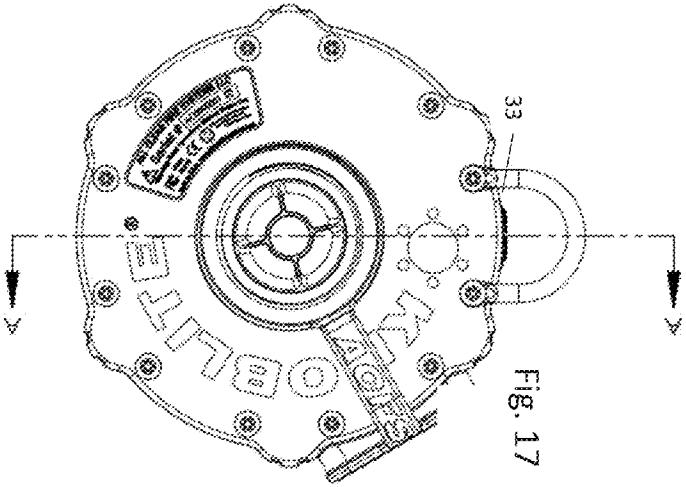
FIG. 17 is a back view of an embodiment of device 10.

The device 10 may be mounted on other items beside a fire nozzle 60 and fire hose coupling 62. Referring now to FIG. 13, the device 10 is shown coupled to a fire engine water cannon 199. As stated above, since the plurality of lighting and video fixtures 14 are positioned around an outer perimeter of the housing 12, the lighting and video fixtures 14 may be directed to illuminate the extinguishing agent exiting the device 10. This helps firefighters determine if the extinguishing agent exiting the device 10 is being properly directed in the right area/location to extinguish the fire.

Referring now to FIGS. 28-34, a carrying unit 200 is shown. The device 200 may be used to carry an apparatus for discharging a fire extinguishing agent such as a fire hose, fire hose nozzle, fire hose couplings, water discharge outlet on a fire engine, water discharge outlet on a fire ladder truck, or the like. The device 200 will be described below for carrying the device 10 disclosed above. However, this should not be seen in a limiting manner.

The carrying unit 200 may be used with the device 10 to allow one to easily remove and move the device 10 from a hose. The carrying unit 200 is generally formed of a lightweight and fire resistant material.

The carrying unit 200 may be formed of a frame. The frame member 202 may have a handle 204 formed member 202 on a top section of the frame member 202. In accordance with one embodiment of the present invention, the handle member 204 may be formed of a tab 206 which extends out and away from the top section of the frame member 202. An opening 208 may be formed in the tab 206. The opening 208 may allow a user to insert a hand in the tab 206 to lift/carry the carrying unit 200. A plurality of indentations 210 may be formed around a top section of the perimeter of the opening 208. The indentations 210 may be used as finger grips to allow the user to more comfortably lift/carry the carrying unit 200.

A bottom leg member 212 may extend out and away from a bottom section of the frame member 202. The bot tom leg member 212 may be cylindrical in shape. The bottom leg member 212 may be sized to allow the bottom leg member 212 to be inserted through pipe 50 positioned through the housing 12 thereby allowing the carrying unit 200 to be coupled to the device 10 in order to carry the device 10. In accordance with one embodiment, a distal end of the bottom leg member 212 may be slightly tapered. This may allow one to more easily insert the bottom leg member 212 through pipe 50. In order to decrease the weight of the carrying unit 200, the bottom leg member 202A may be entirely or partially hollow.

To secure the device 10 on the bottom leg member 212 an end cap 214 or locking device may be removably coupled to a distal end of the bottom leg member 212. The end cap 214 is sized to be larger than the opening of the pipe 50 of the device 10. This allows the end cap 214 to prevent the device 10 from sliding off the bottom leg member 212.

The end cap 214 may have a locking device 215 to removably couple the end cap 214 to the bottom leg member 212. The locking device 215 may take on a plurality of different forms. In accordance with one embodiment of the locking device 215 may be comprised of a rod member 215A that extends from a central area of the end cap 214. The rod member 215A may have threading 215B. The threading 215B may be used to engage threading 212A formed in a channel 212B formed in a closed distal end 212C of the bottom leg member 212. The above is given as one example and should not be seen in a limiting manner. Other devices/methods may be used to removably couple the end cap 214 to the bottom leg member 212 without departing from the spirit and scope of the present invention.

One or more carabiners 216 may be coupled to the carrying unit 200. The carabiners 216 may be coupled at different locations on the carrying" unit 200. In accordance with one embodiment of the carabiners 216 may be coupled to the handle member 204. The carabiners 216 may be used to attach the carrying unit 200 to a user. In accordance with one embodiment, a strap may be attached to the carabiners 216 to allow one to carry the carrying unit 200.

In addition to the above, the device 10 can be equipped with communication upgrades that enhance the quality and effectiveness of communication on the emergency scene. The device 10 can be fitted with components that boost radio/wireless signals on the interior of a structure or in wild land firefighting situations that overcome the obstacles of construction "dead zones" and topography. During time of natural disaster or homeland security threats the device 10 can be affixed to fire engines, ladder trucks, and emergency vehicles acting as mobile cell phone repeaters. When existing cell phone towers are down or dysfunctional, mobile emergency vehicles can patrol disaster areas and answer the emergency needs of citizens previously unable to communicate with civil authorities. Individuals involved in outdoor activities/boating/aviation can use a version of the device 10, equipped with GPS locator, for enhanced lighting and contacting support agencies with an integrated emergency signal during life threatening situations in remote areas (i.e. universal mayday). The device 10 can be equipped with numerous metering/monitoring devices that extract atmospheric samples from the ambient environment, provide real time evaluation of those samples, and provide an alarm to warn emergency responders of possible hazardous conditions. An example would be an integrated component to the device 10 that warns the emergency responders of excessive x-ray or gamma radiation levels in the operational area. The scope and function of the metering/monitoring explanation should in no way be limited by the example. The device 10 can be equipped with numerous personal metering/monitoring devices that evaluate biological functions of the on scene emergency responders (i.e. heart rate, skin temp, etc.) and alert scene commanders of the need to provide medical care or replacement work crews. The same device 10 could contain a GPS chip to allow incident commanders to track the location of fire fighters and other emergency responders in the "hot zone."

While embodiments of the disclosure have been described in terms of various specific embodiments, those skilled in the art will recognize that the embodiments of the disclosure may be practiced with modifications within the spirit and scope of the claims.

What is claimed is:

1. A device for housing electronics and optics at the leading edge of a fire suppression operation comprising:

a housing having a substantially flat front plate with an inner perimeter wall and an outer perimeter wall, a plurality of light unit openings in the front plate at the outer perimeter wall, the inner perimeter wall aligned with a fluid flow path from a center opening in the housing; and a plurality of light source units respectfully positioned in the plurality of light unit openings to emit light forward from the front plate; the light emitted from the light unit openings having a peak luminous intensity directed parallel to or angled toward the fluid flow path exiting the housing; wherein the plurality of light source units each include a high power LED adjacently rearward of a lens, wherein the light source units have a viewing angle between seven and twenty-one degrees and the light source units each direct light parallel to or angled towards a fluid along the fluid flow path exiting the central opening of the device, the viewing angle intersecting the fluid flow within twenty inches of a lens of each of the light source units.

2. A device in accordance with claim 1, wherein the plurality of light unit openings each have light unit opening perimeters and a portion of each light unit opening perimeter is coincident with a portion of the outer perimeter wall of the housing.

3. A device in accordance with claim 1, wherein the center of each light unit opening perimeter is at least 8/10ths of the distance from the center of the fluid flow path to the outer perimeter wall.

4. A device in accordance with claim 3, wherein the front plate is substantially circular and the diameter of the front plate is at least one and a half times larger than the diameter of the center opening.

5. An device in accordance with claim 4, wherein the diameter of the front plate is less than five times larger than the diameter of the center opening.

6. An illumination device in accordance with claim 1, wherein: the plurality of light unit openings are distributed evenly around the front plate.

7. A device in accordance with claim 6, wherein the viewing angle is fourteen degrees.

8. A device in accordance with claim 6, further comprising a stream of extinguishing agent coupled to the housing at the inner perimeter wall, the extinguishing agent having a higher refractive index than air and expelled through the housing along the fluid flow path wherein light from the plurality of high power light source units illuminates the stream of extinguishing agent.

9. A device, comprising:

a housing having a substantially flat front plate with an inner perimeter wall and an outer perimeter wall, a plurality of circular light unit openings in the front plate and aligned with the outer perimeter wall to emit light forward from the front plate, wherein the housing allows a substance to flow through the housing;

a plurality of light source units respectfully positioned in the plurality of light unit openings to emit light forward from the front plate; the light source units having a viewing angle of twice the number of degrees from a centroid at which the luminous intensity drops to half the peak value, between seven and twenty-one degrees, the viewing angle intersecting the substance within twenty inches of a lens of each of the light source units.

10. A device in accordance with claim 9, wherein the plurality of circular light unit openings has a combined surface area of between five and twenty percent of the front plate surface area.

11. A device comprising:

a housing having a housing interior formed by substantially flat front plate, an inner perimeter wall, and an outer perimeter wall, the front plate having a plurality of light unit openings at the outer perimeter wall, the inner perimeter wall aligned with a fluid flow path originating from a center opening in the housing;

a plurality of high power light source units each including a high power LED adjacently rearward of a lens respectfully positioned in the plurality of light unit openings to emit light forward from the front plate, wherein the light source units have a viewing angle between seven and twenty-one degrees and the light source units each direct light parallel to or angled towards a fluid along the fluid flow path exiting the center opening of the device, the viewing angle intersecting the fluid flow within twenty inches of a lens of each of the light source units;

an electronic circuit including the plurality of high power light source units coupled to a battery stored in an interior of the housing to power and illuminate an area forward of the front plate;

a cover with a perimeter shape to fit against the inner perimeter wall and outer perimeter wall and a depth at least as great as the battery, the cover enclosing the plurality of light sources in the housing interior and isolating the battery from the plurality of light sources; and a housing back plate attachable to the exterior side wall to seal the housing interior.

12. A device in accordance with claim 11, wherein the plurality of light unit openings each have light unit opening perimeters and a portion of each light unit opening perimeter is coincident with a portion of the outer perimeter wall.

13. A device in accordance with claim 11 further comprising an insulating ring, the insulating ring with an exterior perimeter shape to fit within and match the housing interior shape, the cover over the plurality of light sources in the housing interior and isolating the battery, the insulating ring positioned against the cover sealing the battery between the cover and the insulating ring.

14. A device in accordance with claim 13 further comprising a cap that houses an interior battery and fits within the cover.

15. The device according to claim 11, wherein the front plate is substantially circular and the diameter of the front plate is at least one and a half times larger than the diameter of the center opening.

16. A device in accordance with claim 15, wherein the diameter of the front plate is less than five times larger than the diameter of the center opening.

* * * * *